US007006065B1

(12) United States Patent
Sugawara et al.

(10) Patent No.: US 7,006,065 B1
(45) Date of Patent: Feb. 28, 2006

(54) GAMMA COMPENSATION METHOD AND CIRCUIT FOR COLOR LIQUID CRYSTAL DISPLAY

(75) Inventors: Noriaki Sugawara, Tokyo (JP); Kouichi Koga, Tokyo (JP)

(73) Assignee: NEC LCD Technologies, Ltd., (JP)

( * ) Notice: Subject to any disclaimer, the term of this patent is extended or adjusted under 35 U.S.C. 154(b) by 0 days.

(21) Appl. No.: 09/707,816

(22) Filed: Nov. 7, 2000

(30) Foreign Application Priority Data

Nov. 8, 1999 (JP) ..... 11-316873

(51) Int. Cl.
*G09G 3/36* (2006.01)

(52) U.S. Cl. ..... 345/89; 358/519; 348/254; 348/674

(58) Field of Classification Search ..... 345/87–104, 345/204, 205, 207, 210–215, 690; 348/674–677, 348/254–256; 358/519
See application file for complete search history.

(56) References Cited

U.S. PATENT DOCUMENTS

| | | | | |
|---|---|---|---|---|
| 4,489,349 | A * | 12/1984 | Okada | 348/674 |
| 4,825,293 | A * | 4/1989 | Kobayashi et al. | 348/229.1 |
| 4,942,458 | A | 7/1990 | Miyajima et al. | 358/29 |
| 5,175,621 | A * | 12/1992 | Maesato | 348/676 |
| 5,483,256 | A * | 1/1996 | Ohi | 345/98 |
| 5,512,948 | A * | 4/1996 | Iwamatsu | 348/255 |
| 5,528,257 | A * | 6/1996 | Okumura et al. | 345/99 |
| 5,691,821 | A * | 11/1997 | Hieda et al. | 348/217.1 |
| 5,764,216 | A | 6/1998 | Tanaka et al. | 345/147 |
| 5,790,707 | A * | 8/1998 | Tanaka et al. | 382/274 |
| 6,160,532 | A * | 12/2000 | Kaburagi et al. | 345/87 |
| 6,295,098 | B1 * | 9/2001 | Motonakano et al. | 348/675 |
| 6,462,735 | B1 * | 10/2002 | Naito | 345/204 |
| 6,483,496 | B1 * | 11/2002 | Kobayashi et al. | 345/98 |
| 6,603,450 | B1 * | 8/2003 | Yamazaki et al. | 345/75.2 |
| 6,657,619 | B1 * | 12/2003 | Shiki | 345/204 |
| 6,697,127 | B1 * | 2/2004 | Suzuki | 348/674 |
| 6,833,876 | B1 * | 12/2004 | Pirjaberi | 348/674 |

FOREIGN PATENT DOCUMENTS

| | | |
|---|---|---|
| JP | 1-124827 | 5/1989 |
| JP | 3-171891 | 7/1991 |
| JP | 5-19725 | 1/1993 |
| JP | 6-205340 | 7/1994 |
| JP | 7-72832 | 3/1995 |
| JP | 8-289236 | 11/1996 |
| JP | 9-168161 | 6/1997 |
| JP | 9-218668 | 8/1997 |
| JP | 10-313416 | 11/1998 |
| JP | 11-15444 | 1/1999 |
| JP | 11-113019 | 4/1999 |

* cited by examiner

*Primary Examiner*—Dennis-Doon Chow
*Assistant Examiner*—Tom Sheng
(74) *Attorney, Agent, or Firm*—Hayes Soloway P.C.

(57) ABSTRACT

A driving method for a color liquid crystal display which drives the color liquid crystal display based on a video red signal, a video green signal and a video blue signal by independently applying a gamma compensation to a clamped video red signal, a clamped video green signal and a clamped video blue signal in gamma compensating circuits in order to make suitable to a red transmittance characteristic, a green transmittance characteristic and a blue transmittance characteristic. With this operation, it is possible to carry out an optimal gamma compensation suitable to a characteristic of the color liquid crystal display and to remove a gradation batter occurring in a specific color.

16 Claims, 21 Drawing Sheets

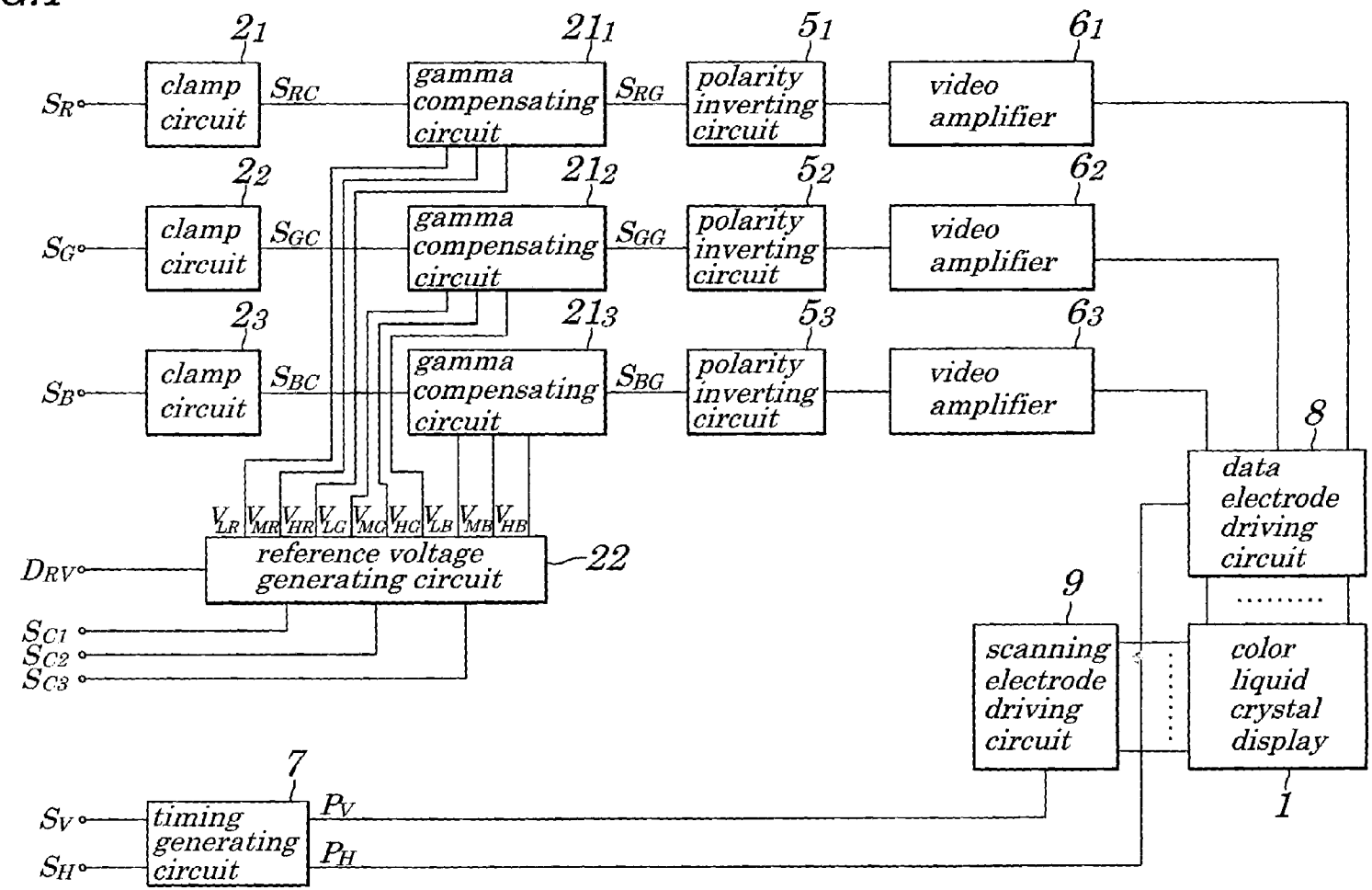
FIG. 1
clamp circuit
clamp circuit
clamp circuit
gamma compensating circuit
gamma compensating circuit
gamma compensating circuit
polarity inverting circuit
polarity inverting circuit
polarity inverting circuit
video amplifier
video amplifier
video amplifier
data electrode driving circuit
color liquid crystal display
scanning electrode driving circuit
reference voltage generating circuit
timing generating circuit
$S_R$
$S_G$
$S_B$
$S_{RC}$
$S_{GC}$
$S_{BC}$
$S_{RG}$
$S_{GG}$
$S_{BG}$
$V_{LR}$ $V_{MR}$ $V_{HR}$ $V_{LG}$ $V_{MG}$ $V_{HG}$ $V_{LB}$ $V_{MB}$ $V_{HB}$
$D_{RV}$
$S_{C1}$ $S_{C2}$ $S_{C3}$
$P_V$ $P_H$
$S_V$ $S_H$
21 22 23 211 212 213 51 52 53 61 62 63 8 9 22 7 1

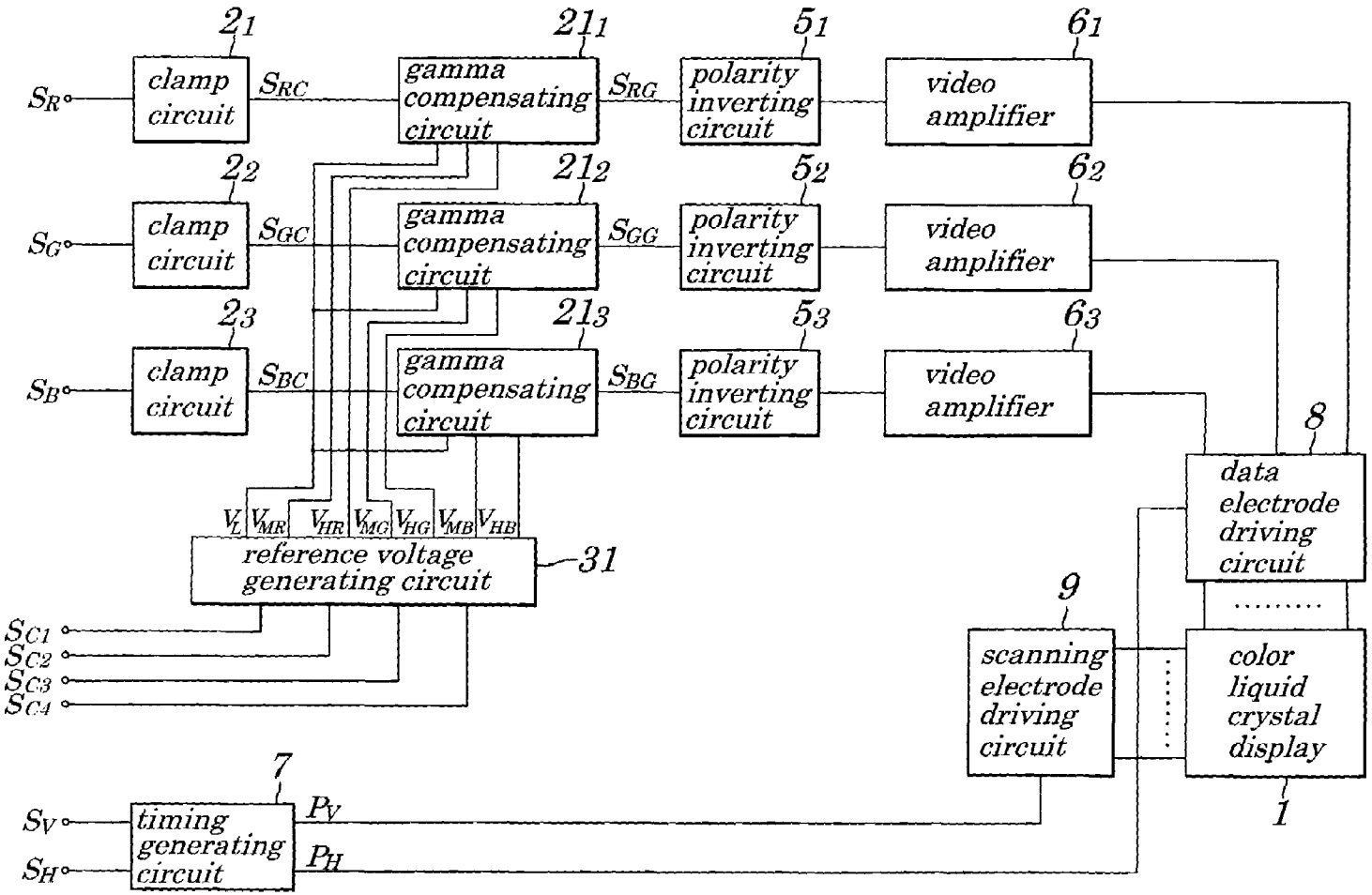
FIG.6
clamp circuit
clamp circuit
clamp circuit
gamma compensating circuit
gamma compensating circuit
gamma compensating circuit
polarity inverting circuit
polarity inverting circuit
polarity inverting circuit
video amplifier
video amplifier
video amplifier
data electrode driving circuit
color liquid crystal display
scanning electrode driving circuit
reference voltage generating circuit
timing generating circuit
$S_R$
$S_G$
$S_B$
$S_{RC}$
$S_{GC}$
$S_{BC}$
$S_{RG}$
$S_{GG}$
$S_{BG}$
$V_L$
$V_{MR}$
$V_{HR}$
$V_{MG}$
$V_{HG}$
$V_{MB}$
$V_{HB}$
$S_{C1}$
$S_{C2}$
$S_{C3}$
$S_{C4}$
$P_V$
$P_H$
$S_V$
$S_H$
21
22
23
$21_1$
$21_2$
$21_3$
$5_1$
$5_2$
$5_3$
$6_1$
$6_2$
$6_3$
7
8
9
1
31

GAMMA COMPENSATION METHOD AND CIRCUIT FOR COLOR LIQUID CRYSTAL DISPLAY

BACKGROUND OF THE INVENTION

1. Field of the Invention

The present invention relates to a driving method and a driving circuit for a color liquid crystal display and more particularly to the driving method and the driving circuit for driving the color liquid crystal display based on a gamma compensated video signal.

The present application claims the Convention Priority of Japanese Patent Application No. Hei11-316873 filed on Nov. 8, 1999, which is hereby incorporated by reference.

2. Description of the Related Art

FIG. 19 is a block diagram showing a conventional electric configuration of a driving circuit of an analog circuit configuration of a color liquid crystal display 1.

The color liquid crystal display 1 is a liquid crystal display of an active matrix driving type using a TFT (Thin Film Transistor) as a switching element, in which intersection points of plural scanning electrodes (gate lines) provided at predetermined intervals in a row direction and plural data electrodes (source lines) provided at predetermined intervals in a column direction are used as pixels, for each pixel, a liquid cell of a equivalent capacitive load, a TFT for driving a corresponding liquid crystal cell, a capacitor for keeping data charges during one vertical synchronous period are arranged, a data red signal, a data green signal and a data blue signal generated based on a video red signal $S_R$, a video green signal $S_G$, a video blue signal $S_B$, are applied to the data electrode and a scanning signal generated based on a horizontal synchronous signal $S_H$ and a vertical synchronous signal $S_V$ is applied to a scanning electrode, and then a color character, a color image and a like are displayed. In addition, the color liquid crystal display 1 is a normal white type having a high transmittance when no voltage is applied.

Further, the driving circuit of the color liquid crystal display 1 is mainly provided with clamp circuit $\mathbf{2}_1$ to clamp circuit $\mathbf{2}_3$, a reference voltage generating circuit 3, gamma compensating circuit $\mathbf{4}_1$ to gamma compensating circuit $\mathbf{4}_3$, polarity inverting circuit $\mathbf{5}_1$ to polarity inverting circuit $\mathbf{5}_3$, video amplifier $\mathbf{6}_1$ to video amplifier $\mathbf{6}_3$, a timing generating circuit 7, a data electrode driving circuit 8 and a scanning electrode driving circuit 9.

Clamp circuit $\mathbf{2}_1$ to clamp circuit $\mathbf{2}_3$ execute a clamp fixing (direct current refreshing) a level of a top or a back porch of the horizontal synchronous signal $S_H$ of the video red signal $S_R$, the video green signal $S_G$ and the video blue signal $S_B$ supplied from outside to a black level and output a video red signal $S_{RC}$, a video green signal $S_{GC}$ and a video blue signal $S_{BC}$.

The reference voltage generating circuit 3 a generates a reference voltage $V_L$, a reference voltage $V_M$, a reference voltage $V_H$ used to gamma compensate the video red signal $S_{RC}$, the video green signal $S_{GC}$ and the video blue signal $S_{BC}$ and supplies the video red signal $S_{RC}$, the video green signal $S_{GC}$ and the video blue signal $S_{BC}$ to gamma compensating circuit $\mathbf{4}_1$ to gamma compensating circuit $\mathbf{4}_3$. Gamma compensating circuit $\mathbf{4}_1$ to gamma compensating circuit $\mathbf{4}_3$, based on the reference voltage $V_L$, the reference voltage $V_M$ and the reference voltage $V_H$ supplied from the reference voltage generating circuit 3, give a gradient to the video red signal $S_{RC}$, the video green signal $S_{GC}$ and the video blue signal $S_{BC}$ by gamma compensating the video red signal $S_{RC}$, the video green signal $S_{GC}$ and the video blue signal $S_{BC}$ and output them as the video red light $S_{RG}$, the video green light $S_{GG}$ and the video blue light $S_{BG}$.

Here, the gamma compensation will be explained. For example, when a logarithm value of a luminance originally provided for a subject such as a view and a person taken by a video camera is set to a horizontal axis and a logarithm value of a luminance of a reproduced image displayed on a display by a video signal from the video camera is set to a vertical axis and then an inclination angle of a reproducing characteristic curve is set to θ, tan θ is called a gamma (γ). When the luminance of the subject is reproduced on the display with fidelity, namely, when an input (horizontal axis) increases or decreases by one and also an output (vertical axis) increases or decreases by one, the inclination angle of the reproducing characteristic curve is a straight line having an inclination angle of 45°, tan 45°=1 and then the gamma becomes 1. Therefore, in order to reproduce the luminance of the subject with fidelity, it is necessary to set a gamma of a whole system including taking the subject by the video camera though reproducing an image on the display to gamma=1.

However, an image pickup element such as CCD (Charge Coupled Device), a CRT (Cathode Ray Tube) display or a like making up a video camera has a peculiar gamma. A gamma of the CCD is 1 and a gamma of the CRT display is about 2.2.

Therefore, it is necessary to compensate a video signal in order to obtain a reproduced image of good gradation by setting gamma=1 as a whole system, and this is called gamma compensation. Generally, the gamma compensation is applied to the video signal so as to be suitable to a gamma characteristic of the CRT display.

Polarity inverting circuit $\mathbf{5}_1$ to polarity inverting circuit $\mathbf{5}_3$, in order to alternately drive the color liquid crystal display 1, invert respective polarities of the video red light $S_{RG}$, the video green light $S_{GG}$ and the video blue light $S_{BG}$ and output them. Video amplifier $\mathbf{6}_1$ to video amplifier $\mathbf{6}_3$ amplify the video red light $S_{RG}$, the video green light $S_{GG}$ and video blue light $S_{BG}$ which are polarity-inverted to a level until the color liquid crystal display 1 can be driven. The timing generating circuit 7, based on the horizontal synchronous signal $S_H$ and the vertical synchronous signal $S_V$ supplied from outside, generates a horizontal scanning pulse $P_H$ and a verticality scanning pulse $P_V$ and supplies the horizontal scanning pulse $P_H$ and the verticality scanning pulse $P_V$ to the data electrode driving circuit 8 and the scanning electrode driving circuit 9. The data electrode driving circuit 8 generates a data red signal, a data green signal, a data blue signal from the video red light $S_{RG}$, the video green light $S_{GG}$ and the video blue light $S_{BG}$ which are amplified and polarity-inverted and applies the data red signal, the data green signal and the data blur signal to corresponding data electrodes in the color liquid crystal display 1 at a timing of the horizontal scanning pulse $P_H$ supplied from the timing generating circuit 7.

The scanning electrode driving circuit 9 generates a scanning signal and supplies the scanning signal to a corresponding scanning electrode in the color liquid crystal display 1 at a timing of the vertical scanning pulse $P_V$ supplied from the timing generating circuit 7.

Further, FIG. 20 is a block diagram showing a second conventional electric configuration of a driving circuit of a digital circuit configuration for the color liquid crystal display 1.

The driving circuit for the color liquid crystal display 1 is mainly provided with a controlling circuit 11, a gradation power supply circuit 12, a data electrode driving circuit 13 and a scanning electrode driving circuit 14.

The controlling circuit 11 is, for example, an ASIC (Application Specific Integrated Circuit), supplies red data $D_R$ of six bits, green data $D_G$ of six bits and blue data $D_B$ of six bits supplied from outside to the data electrode driving circuit 13 and generates a horizontal scanning pulse $P_H$, a vertical scanning pulse $P_V$ and a polarity inverting pulse POL for alternately driving the color liquid crystal display 1 and supplies them to the data electrode driving circuit 13 and the scanning electrode driving circuit 14. The gradation power supply circuit 12, as shown in FIG. 21, is provided with resistor $\mathbf{15}_1$ to resistor $\mathbf{15}_{11}$ connected longitudinally between a reference voltage $V_{REF}$ and ground and voltage follower $\mathbf{16}_1$ to voltage follower $\mathbf{16}_9$ connected with connection points of resistors adjacent to respective input terminals, and applies buffer to a gradation voltage $V_0$ to a gradation voltage $V_9$ set for the gamma compensation and appearing at connection points of adjacent resistors and supplies gradation voltage $V_0$ to gradation voltage $V_9$ to the data electrode driving circuit 13.

The data electrode driving circuit 13, as shown in FIG. 21, is mainly provided with a multiplexer (MPX) 17, a DAC 18 and voltage follower 19, to voltage follower $\mathbf{19}_{384}$. In addition, a real data electrode driving circuit is provided with a shift register, a data register, a latch and a level shifter at a front step of the DAC 18, however, these elements and operations are not directly related with features of the present invention, therefore, explanations are omitted in this specification and they are not shown.

The multiplexer MPX 17 switches a group of gradation voltage $V_0$ to gradation voltage $V_4$ and a group of gradation voltage $V_5$ to gradation voltage $V_9$ among gradation voltage $V_0$ to gradation voltage $V_9$ supplied from the gradation power supply circuit 12, based on the polarity inverting pulse POL supplied from the controlling circuit 11 and supplies one of the groups to the DAC The DAC 18 applies the gamma compensation to the red data $D_R$ of six bits, the green data $D_G$ of six bits and the blue data $D_B$ of six bits supplied from the controlling circuit 11, converts the red data $D_R$, the green data $D_G$ and the blue data $D_B$ into an analog data red signal, an analog green signal and an analog blue signal and supplies the analog data red signal, the analog green signal and the analog blue signal to voltage follower $\mathbf{19}_1$ to voltage follower $\mathbf{19}_{384}$, based on the group of gradation voltage $V_0$ to gradation voltage $V_4$ and the group of gradation voltage $V_5$ to gradation voltage $V_9$. Voltage follower $\mathbf{19}_1$ to voltage follower $\mathbf{19}_{384}$ apply buffer to the analog data red signal, the analog data green signal and the analog data blue signal supplied from the DAC 18 and apply these data signals to corresponding data electrodes in the color liquid crystal display 1.

The scanning electrode driving circuit 14 sequentially generates scanning signals and sequentially applies the scanning signals to corresponding scanning electrodes in the color liquid crystal display 1 at a timing of the vertical scanning pulse $P_V$ supplied from the timing generating circuit 7.

Now, in the driving circuit for the color liquid crystal display 1 of the first conventional example, the gamma compensation is applied to the video red signal $S_{RC}$, the video green signal $S_{GC}$ and the video blue signal $S_{BC}$ based on the common reference voltage $V_L$, the common reference voltage $V_M$, the common reference voltage $V_H$, so that the gamma characteristic of the CRT display (gamma is about 2.2) is suitable for the video red signal $S_{RC}$, the video green signal $S_{GC}$ and the video blue signal $S_{BC}$.

Further, in the driving circuit for the color liquid crystal display 1 of the second conventional example, the gamma compensation is applied to the red data $D_R$, the green data $D_G$ and the blue data $D_B$ based on the common gradation reference voltage $V_0$ to the common reference voltage $V_4$ and common gradation reference voltage $V_5$ to common gamma reference voltage $V_9$ so that the gamma characteristic of the CRT display (gamma is about 2.2) is suitable for the red data $D_R$, the green data $D_G$ and the blue data $D_B$.

However, a color liquid crystal display 1 has a gamma characteristic different from that of a CRT display, a characteristic curve of a transmittance T for an applied voltage V (a V-T characteristic curve) is not linear, and particularly, the transmittance hardly changes against a change of the applied voltage near a black level. Further, since the V-T characteristic curve of the color liquid crystal display, as shown in FIG. 22, is different for each of a red (curve a), a green (curve b) and a blue (curve c), a characteristic curve of the luminance (an output) for the gradation (an input), as shown in FIG. 23, is different for each of the red (curve a), the green (curve b) and the blue (curve c). In FIG. 23, the luminance is a relative luminance in which the gamma compensation is applied to the video signal so as to be suitable to a gamma characteristic of a CRT display (about 2.2 gamma) in the gamma compensating circuit.

Accordingly, in the conventional gamma compensation common with the red, the green and the blue and making suitable to the gamma characteristic of the CRT display (about 2.2 gamma), for example, in a case of the V-T characteristic curve shown in FIG. 22, a transmittance is set to 100% when an applied voltage is 1.7 V, namely, a white level is set. However, particularly in the green (curve b), a white level is set at transmittance of 80%, therefore, it is impossible to carry out an optimal gamma compensation and then it is impossible to obtain a reproduced image of a good gradation. As a result, there a disadvantage in that it is impossible to meet a recent need of a high video quality.

Further, recently, in order to meet the need of the high video quality, a color liquid crystal display having a high transmittance is developed, and FIG. 24 shows an example of a V-T characteristic curve of a color liquid crystal display having such a high transmittance characteristic red (curve a), green (curve b), blue (curve c)). In such the V-T characteristic curve, each of red (curve a), green (curve b) and blue (curve c) has a transmittance of 100%, namely, each best luminance is too different, therefore, there is a problem in that the color liquid crystal display 1 cannot be used since it is impossible to deal with gamma characteristics of the conventional gamma compensation which are used in common with red, green and blue.

Furthermore, as above described, in the first conventional example and the second conventional example of a driving circuit for the color liquid crystal display, gamma compensation is applied based on common reference voltage $V_L$, common reference voltage $V_M$ and common reference voltage $V_H$ or a common group of gradation voltage $V_0$ to gradation voltage $V_4$ and a common group of gradation voltage $V_5$ to gradation voltage $V_9$, therefore, there is a problem in that, though a gradation batter occurs in which gradation change is not displayed on a display as luminance changes, the gradation batter can not be removed.

SUMMARY OF THE INVENTION

In view of the above, it is an object of the present invention to provide a driving method and a driving circuit for a color liquid crystal display capable of carrying out a gamma compensation fully suitable to a characteristic of the color liquid crystal display and capable of removing a gradation batter though the gradation batter occurs in a specific color among red, green and blue.

According to a first aspect of the present invention, there is provided a driving method for a color liquid crystal display including:

a step of applying gamma compensations making suitable to a red transmittance characteristic, a green transmittance characteristic and a blue transmittance characteristic for an applied voltage of the color liquid crystal display to a video red signal, a video green signal and a video blue signal independently in order to obtain a compensated video red signal, a compensated video green signal and a compensated blue signal; and a step of driving the color liquid crystal display based on the compensated video red signal, the compensated video green signal and the compensated blue signal.

According to a second aspect of the present invention, there is provided a driving method for a color liquid crystal display including:

a step of applying gamma compensations, each of the gamma compensations including a first gamma compensation of voluntarily giving a luminance characteristic of a reproduced image to an input image luminance and a second gamma compensation of making suitable to a red transmittance characteristic, a green transmittance characteristic and a blue transmittance characteristic for an applied voltage of the color liquid crystal display to a video red signal, a video green signal and a video blue signal independently in order to obtain a compensated video red signal, a compensated video green signal and a compensated blue signal; and a step of driving the color liquid crystal display based on the compensated video red signal, the compensated video green signal and the compensated blue signal.

In the foregoing, a preferable mode is one wherein the gamma compensations are applied using a common voltage or a common data to the video red signal, the video green signal and the video blue signal corresponding to an area in which the red transmittance characteristic, the green transmittance characteristic and the blue transmittance characteristic for the applied voltage for the color liquid crystal display become an approximate similar characteristic curve.

Also, a preferable mode is one wherein voltages or data used for the gamma compensations are independently set in an area from a minimum transmittance to a maximum transmittance of each of the red transmittance characteristic, the green transmittance characteristic and the blue transmittance characteristic for the applied voltage for the color liquid crystal display.

Furthermore, a preferable mode is one wherein the voltages or the data are independently changeable.

According to a third aspect of the present invention, there is provided a driving circuit for a color liquid crystal display including:

a first gamma compensating circuit for applying a gamma compensation of compensating a video red signal so as to be suitable to a red transmittance characteristic for an applied voltage in the color liquid crystal display and for outputting a compensated video red signal;

a second gamma compensating circuit for applying a gamma compensation of compensating a video green signal so as to be suitable to a green transmittance characteristic in the applied voltage of the color liquid crystal display and for outputting a compensated video green signal;

a third gamma compensating circuit for applying a gamma compensation of compensating a video blue signal so as to be suitable to a blue transmittance characteristic for the applied voltage of the color liquid crystal display and for outputting a compensated video blue signal;

a reference voltage generating circuit for supplying respectively reference voltages to the first gamma compensating circuit, the second gamma compensating circuit and the third gamma compensating circuit; and a data electrode driving circuit for driving corresponding electrodes of the color liquid crystal display based on the compensated video red signal, the compensated green signal and the compensated video blue signal.

According to a fourth aspect of the present invention, there is provided a driving circuit for a color liquid crystal display including:

a first gamma compensating circuit for applying a gamma compensation to a video red signal, the gamma compensation including a first gamma compensation of voluntarily giving a luminance characteristic of a reproduced image for an input image luminance and a second gamma compensation of compensating the video red signal so as to be suitable to a red transmittance characteristic for an applied voltage in the color liquid crystal display and for outputting a compensated video red signal;

a second gamma compensating circuit for applying a gamma compensation to a video green signal, the gamma compensation including a first gamma compensation of voluntarily giving a luminance characteristic of a reproduced image for an input image luminance and a second gamma compensation of compensating the video green signal so as to be suitable to a green transmittance characteristic for an applied voltage of the color liquid crystal display and for outputting a compensated video green signal;

a third gamma compensating circuit for applying a gamma compensation to a video blue signal, the gamma compensation including a first gamma compensation of voluntarily giving a luminance characteristic of a reproduced image for an input image luminance and a second gamma compensation of compensating the video blue signal so as to be suitable to a blue transmittance characteristic for an applied voltage of the color liquid crystal display and for outputting a compensated video blue signal;

a reference voltage generating circuit for supplying respective reference voltages to the first gamma compensating circuit, the second gamma compensating circuit and the third gamma compensating circuit; and a data electrode driving circuit for driving corresponding electrodes in the color liquid crystal display based on the compensated video red signal, the compensated video green signal and the compensated video blue signal.

In the forgoing, a preferable mode is one wherein the reference voltage generating circuit supplies a common reference voltage to the video red signal, the video green signal and the video blue signal corresponding to an area in which the red transmittance characteristic, the green transmittance characteristic and the blue transmittance characteristic for the applied voltage in the color liquid crystal display become an approximate similar characteristic curve.

Also, a preferable mode is one wherein the reference voltages are independently set for each area from a minimum transmittance to a maximum transmittance in each of the red transmittance characteristic, the green transmittance characteristic and the blue transmittance characteristic for the applied voltage for the color liquid crystal display.

Furthermore, a preferable mode is one wherein the reference voltages are independently changeable.

According to a fifth aspect of the present invention, there is provided a driving circuit for a color liquid crystal display including:

a gradation power supply circuit for generating a plurality of red gradation voltages, a plurality of green gradation voltages and a plurality of blue gradation voltages used for independently applying a gamma compensation to a video red signal, a video green signal and a video blue signal in order to compensate the video red signal, the video green signal and the video blue signal so as to be suitable to a red transmittance characteristic, a green transmittance characteristic and a blue transmittance characteristic for an applied voltage in the color liquid crystal display; and a data electrode driving circuit for applying a data red signal, a data green signal and a data blue signal obtained by applying the gamma compensation to a red data, a green data and a blue data and by analog-converting the red data, the green data and the blue data based on the plurality of red gradation voltages, the plurality of green gradation voltages and the plurality of blue gradation voltages to corresponding data electrodes of the color liquid crystal display.

According to a sixth aspect of the present invention, there is provided a driving circuit for a color liquid crystal display including:

a gradation power supply circuit for generating a plurality of red gradation voltages, a plurality of green gradation voltages and a plurality of blue gradation voltages used for independently applying a gamma compensation to a video red signal, a video green signal and a video blue signal, the gamma compensation including a first gamma compensation of voluntarily giving a luminance characteristic of a reproduced image for an input image luminance and a second gamma compensation of compensating the video blue signal so as to be suitable to a blue transmittance characteristic for an applied voltage of the color liquid crystal display; and a data electrode driving circuit for applying a data red signal, a data green signal and a data blue signal obtained by applying a gamma compensation to a red data, a green data and a blue data and by analog-converting the red data, the green data and the blue data based the plurality of red gradation voltages, the plurality of green gradation voltages and the plurality of blue gradation voltages to corresponding data electrodes of the color liquid crystal display.

In the forgoing, a preferable mode is one wherein the gradation power supply circuit generates a common gradation voltage to the video red signal, the video green signal and the video blue signal corresponding to an area in which the red transmittance characteristic, the green transmittance characteristic and the blue transmittance characteristic for the applied voltage for the color liquid crystal display become an approximate similar characteristic curve.

Also, a preferable mode is one wherein the plurality of red gradation voltages, the plurality of green gradation voltages and the plurality of blue gradation voltages are independently set for each area from a minimum transmittance to a maximum transmittance in each of the red transmittance characteristic, the green transmittance characteristic and the blue transmittance characteristic in the applied voltage in the color liquid crystal display.

Furthermore, a preferable mode is one wherein the plurality of red gradation voltages, the plurality of green gradation voltages and the plurality of blue gradation voltages are independently changeable.

According to a seventh aspect of the present invention, there is provided a driving circuit for a color liquid crystal display including:

a first gamma compensating section for applying a gamma compensation to a digital video red signal, the gamma compensation including a first gamma compensation of voluntarily giving a luminance characteristic of a reproduced image for an input image luminance and a second gamma compensation of compensating the digital video red signal so as to be suitable to a red transmittance characteristic for an applied voltage of the color liquid crystal display and for outputting a compensated digital video red signal;

a second gamma compensating section for applying a gamma compensation to a digital video green signal, the gamma compensation including a first gamma compensation of voluntarily giving a luminance characteristic of a reproduced image for an input image luminance and a second gamma compensation of compensating the digital video green signal so as to be suitable to a green transmittance characteristic for an applied voltage in the color liquid crystal display and for outputting a compensated digital video green signal;

a third gamma compensating section for applying a gamma compensation to a digital video blue signal, the gamma compensation including a first gamma compensation of voluntarily giving a luminance characteristic of a reproduced image for an input image luminance and a second gamma compensation of compensating the digital video blue signal so as to be suitable to a blue transmittance characteristic for an applied voltage of the color liquid crystal display and for outputting a compensated digital video blue signal; and a data electrode driving circuit for applying a data red signal, a data green signal and a data blue signal obtained by analog-converting a compensated red data, a compensated green data and a compensated blue data to corresponding electrodes of the color liquid crystal display.

According to an eighth aspect of the present invention, there is provided a driving circuit for a color liquid crystal display including:

a first gamma compensating section for applying a gamma compensation to a digital video red signal, the gamma compensation including a first gamma compensation of voluntarily giving a luminance characteristic of a reproduced image for an input image luminance and a second gamma compensation of compensating a video red signal so as to be suitable to a red transmittance characteristic for an applied voltage of the color liquid crystal display, the second gamma compensation including a second gamma slight compensation of executing a compensation caused by a difference among a red characteristic, a green characteristic and a blue characteristic and for outputting a compensated video red signal;

a second gamma compensating section for applying a gamma compensation to a digital video green signal, the gamma compensation including a first gamma compensation of voluntarily giving a luminance characteristic of a reproduced image for an input image luminance and a second gamma compensation of compensating the video green signal to be suitable to a green transmittance characteristic for an applied voltage of the color liquid crystal display, the second gamma compensation including a second gamma slight compensation of executing a compensation caused by a difference among the red characteristic, the green characteristic and the blue characteristic and for outputting a compensated video green signal;

a third gamma compensating section for applying a gamma compensation to a digital video blue signal, the gamma compensation including a first gamma compensation of voluntarily giving a luminance characteristic of a reproduced image for an input image luminance and a second gamma compensation of compensating the video blue signal to be suitable to a blue transmittance characteristic for an applied voltage of the color liquid crystal display, the second gamma compensation including a second gamma slight compensation of executing a compensation caused by a difference among the red characteristic, the green characteristic and the blue characteristic and for outputting a compensated video blue signal;

a gradation power supply circuit for generating a plurality of red gradation voltages, a plurality of green gradation voltages and a plurality of blue gradation voltages used to apply a second gamma rough compensation caused by a similarity among the red characteristic, the green characteristic and the blue characteristic to compensated red data, compensated green data and compensated blue data included in the second gamma compensation making suitable to the red transmittance characteristic, the green transmittance characteristic and the blue transmittance characteristic for an applied voltage of the color liquid crystal display; and a data electrode driving circuit for applying a data red signal, a data green signal and a data blue signal obtained by applying the gamma rough compensation to the compensated red data, the compensated green data and the compensated blue data and by analog-converting the compensated red data, the compensated green data and the blue data based on the plurality of red gradation voltages, the plurality of green gradation voltages and the plurality of blue gradation voltages to corresponding electrodes of the color liquid crystal display.

In the forgoing, a preferable mode is one wherein the first gamma compensating section, the second gamma compensating section and the third gamma compensating section apply the gamma compensation to the red data, the green data and the blue data by operation processes.

Also, a preferable mode is one wherein the first gamma compensating section, the second gamma compensating section and the third gamma compensating section previously hold the compensated red data, the compensated green data and the compensated blue data which are results of the gamma compensation corresponding to the red data, the green data and the blue data and the compensated red data, the compensated green data and the compensated blue data are read using the red data, the green data and the blue data as reference addresses so as to be corresponded in order to apply the gamma compensation.

Furthermore, a preferable mode is one wherein the first gamma compensating section, the second gamma compensating section and the third gamma compensating section independently apply the gamma compensation in each area from a minimum transmittance to a maximum transmittance of each of a red transmittance characteristic, a green transmittance characteristic and a blue transmittance characteristic for the applied voltage of the color liquid crystal display.

With the above configurations, it is possible to carry out an optimal gamma compensation fully suitable to a characteristic of a color liquid crystal display. Also, though a gradation batter occurs in a specific color among red, green and blue, it is possible to remove the gradation batter.

Also, since the color liquid crystal display is driven based on the compensated video red signal, the compensated video green signal and the compensated video blue signal obtained by independently applying gamma compensations to the video red signal, the video green signal and the video blue signal so as to be suitable to the red transmittance characteristic, the green transmittance characteristic and the blue transmittance characteristic for an applied voltage to the color liquid crystal display, it is possible to carry out an optimal gamma compensation fully suitable to a characteristic of the color liquid crystal display. Thus, it is possible to fully meet a recent need of a high quality image. Also, it is possible to use a color liquid crystal display having a high transmittance characteristic in which maximum luminance are very different concerning red, green and blue. Furthermore, though the gradation batter occurs in a specific color among red, green and blue, a voltage for the gamma compensation concerning the specific color can be changed, therefore, it is possible to remove the gradation batter of the specific color.

Also, using the common voltage or the common data, the gamma compensation can be applied to the video red signal, the video green signal and the video blue signal corresponding to an area in which characteristic curves become an approximately similar form in the red transmittance characteristic, the green transmittance characteristic and blue transmittance characteristic, therefore, it is possible to reduce a circuit scale.

Further, the first gamma compensating section, the second gamma compensating section and the third gamma compensating section previously memorize the compensated red data, the compensated green data and the compensated blue data corresponding red data, green data and blue data, read the corresponding compensated red data, the corresponding compensated green data and the corresponding compensated blue data using the red data, the green data. And then, the first gamma compensating section, the second gamma compensating section and the third gamma compensating section apply the blue data as reference addresses and the gamma compensation, it is possible to execute the gamma compensation at higher speed.

BRIEF DESCRIPTION OF THE DRAWINGS

The above and other objects, advantages, and features of the present invention will be more apparent from the following description taken in conjunction with the accompanying drawings in which:

FIG. 1 is a block diagram showing an electrical configuration of a driving circuit for a color liquid crystal display according a first embodiment of the present invention;

FIG. 6 is a block diagram showing an electrical configuration of a driving circuit for a color liquid crystal display according a second embodiment of the present invention;

DETAILED DESCRIPTION OF THE PREFERRED EMBODIMENTS

Best modes for carrying out the present invention will be described in further detail using various embodiments with reference to the accompanying drawings.

First Embodiment

FIG. 1 is a block diagram showing an electrical configuration of a driving circuit of an analog circuit configuration for a color liquid crystal display 1 according to a first embodiment of the present invention. In FIG. 1, the color liquid crystal display 1 is a liquid crystal display of an active matrix driving type using a TFT (Thin Film Transistor) as a switching element.

Figure 19:
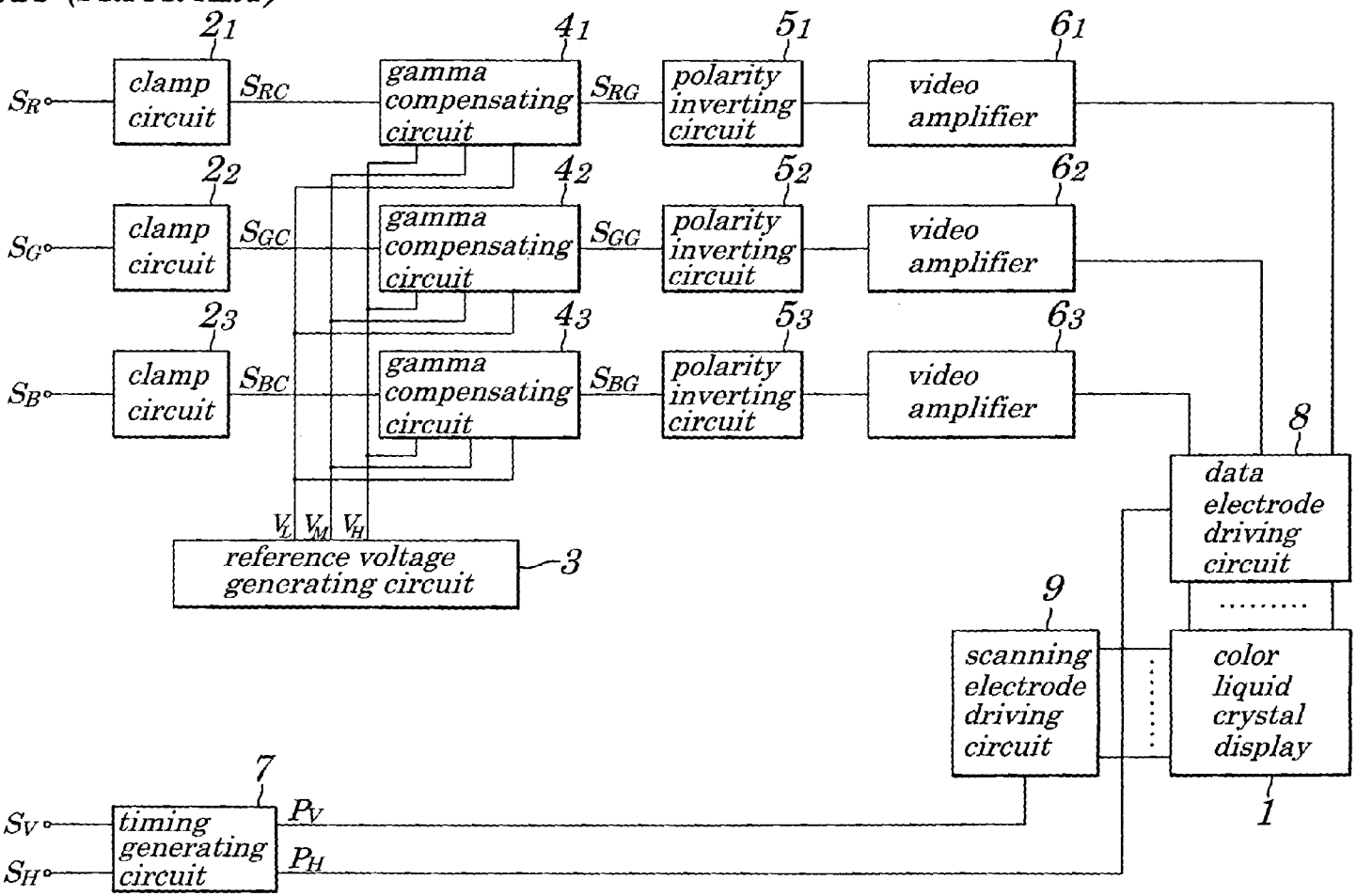
FIG. 19 (PRIOR ART)
FIG. 19 a block diagram showing a first conventional example of an electrical configuration of a driving circuit for a color liquid crystal display.

The driving circuit of the color liquid crystal display 1 is mainly provided with clamp circuit $\mathbf{2}_1$ to clamp circuit $\mathbf{2}_3$, a reference voltage generating circuit 22, gamma compensating circuit $\mathbf{21}_1$ to gamma compensating circuit $\mathbf{21}_3$, polarity inverting circuit $\mathbf{5}_1$ to polarity inverting circuit $\mathbf{5}_3$, video amplifier $\mathbf{6}_1$ to video amplifier $\mathbf{6}_3$, a timing generating circuit 7, a data electrode driving circuit 8 and a scanning electrode driving circuit 9. That is, the reference voltage generating circuit 22, and gamma compensating circuit $\mathbf{21}_1$ to gamma compensating circuit $\mathbf{21}_3$ are provided instead of the reference voltage generating circuit 3, and gamma compensating circuit $\mathbf{4}_1$ to gamma compensating circuit $\mathbf{4}_3$ in a conventional example shown in FIG. 19.

Gamma compensating circuit $\mathbf{21}_1$ to gamma compensating circuit $\mathbf{21}_3$, based on a reference voltage $V_{LR}$, a reference voltage $V_{MR}$, a reference voltage $V_{HR}$, a reference voltage $V_{LG}$, reference voltage $V_{MG}$, a reference voltage $V_{HG}$, a reference voltage $V_{LB}$, a reference voltage $V_{MB}$ and a reference voltage $V_{HB}$ supplied from the reference voltage generating circuit 22, apply gamma compensation to the video red signal $S_{RC}$, the video green signal $S_{GC}$ and the video blue signal $S_{BC}$ independently in order to give gradients to them and then output the video red signal $S_{RG}$, the video green signal $S_{GG}$ and the video blue signal $S_{BG}$. In addition, it is assumed that the gamma compensation in the first embodiment includes a gamma compensation (hereunder, called a first gamma compensation) for giving a luminance characteristic of a reproduced image for a luminance of an input image voluntarily and a gamma compensation (hereunder, called a second gamma compensation) suitable to each of a red V-T characteristic, a green V-T characteristic and a blue V-T characteristic in the color liquid crystal display 1.

Figure 2:
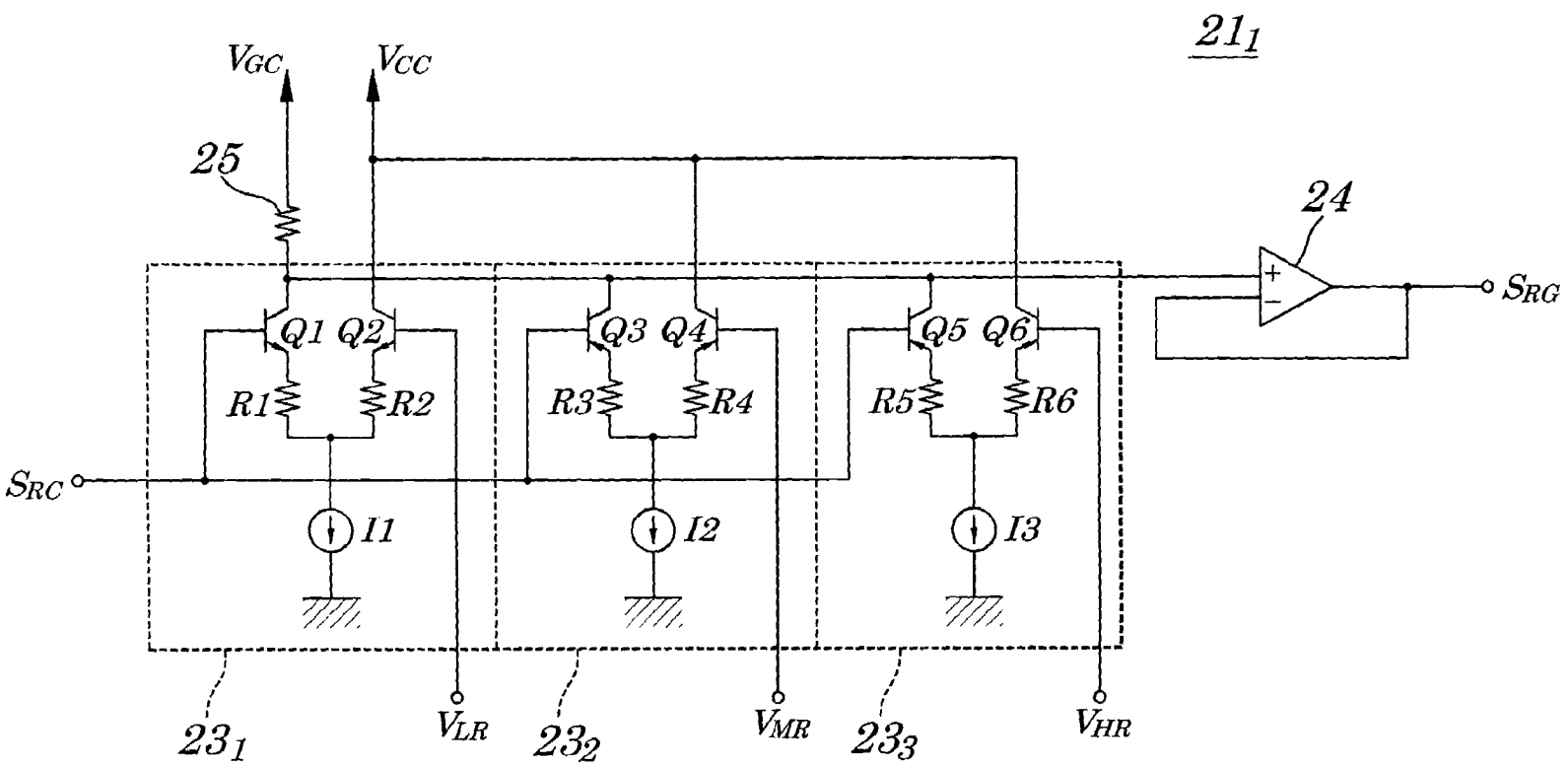
FIG. 2 is a schematic circuit diagram showing an example of an electrical configuration of a gamma compensating circuit in the driving circuit for the color liquid crystal display of the first embodiment.

Here, FIG. 2 shows an example of an electric configuration of the gamma compensating circuit $\mathbf{21}_1$. The gamma compensating circuit $\mathbf{21}_1$ is mainly provided with differential circuit $\mathbf{23}_1$ to differential circuit $\mathbf{23}_3$, a voltage follower 24 and a resistor 25.

The differential circuit 23, is mainly provided with a transistor Q1 in which the video red signal $S_{RC}$ is applied to a base, a setting voltage $V_{GC}$ is applied to a collector through the resistor 25 and the collector is connected to each collector of a transistor Q3 and a transistor Q5 and an emitter is connected to a constant current source I1 through a resistor R1 and a transistor Q2 in which the reference voltage $V_{LR}$ is applied to a base, a power supply voltage $V_{CC}$ is applied to a collector, an emitter is connected to the constant current source Il through a resistor R2. Similarly, a differential circuit $\mathbf{23}_3$ is mainly provided with the transistor Q5 in which the video red signal $S_{RC}$ is applied to a base, the setting voltage $V_{GC}$ is applied to a collector through the resistor 25 and the collector is connected to each collector of the transistor Q1 and the transistor Q3 and an emitter is connected to a constant current source I3 through a resistor R3 and a transistor Q4 in which the reference voltage $V_{MR}$ is applied to abase, the power supply voltage the $V_{CC}$ is applied to a collector, an emitter is connected to the constant current source I2 through a resistor R4. Similarly, a differential circuit $\mathbf{23}_2$ is mainly provided with the transistor Q3 in which the video red signal $S_{RC}$ is applied to a base, the setting voltage $V_{GC}$ is applied to a collector through the resistor 25 and the collector is connected to each collector of the transistor Q1 and the transistor Q5 and an emitter is connected to a constant current source I3 through a resistor R5 and the transistor Q6 in which the reference voltage $V_{HR}$ is applied to a base, the power supply voltage the $V_{CC}$ is applied to a collector, an emitter is connected to the constant current source I3 through a resistor R6. Further, each of the collectors of the transistor Q1, the transistor Q3 and the transistor Q5 is connected to an input terminal of the voltage follower 24. The voltage follower 24 applies buffer to the video red signal $S_{RC}$ which is gamma compensated and outputs it.

The reference voltage generating circuit 22 (FIG. 1), based on a control signal $S_{C1}$, a control signal $S_{C2}$, a control signal $S_{C3}$ and a reference voltage change data $D_{RV}$ supplied from a CPU (Central Processing Unit) not shown, generates the reference voltage $V_{LR}$, the reference voltage $V_{MR}$, the reference voltage $V_{HR}$, the reference voltage $V_{LG}$, the reference voltage $V_{MG}$, the reference voltage $V_{HG}$, the reference voltage $V_{LB}$, the reference voltage $V_{MB}$ and the reference voltage $V_{HB}$ used for gamma compensating the video red signal $S_{RC}$, the video green signal $S_{GC}$ and the video blue signal $S_{BC}$ and supplies these reference voltages to gamma compensating circuit $\mathbf{21}_1$ to gamma compensating circuit $\mathbf{21}_3$.

Figure 3:
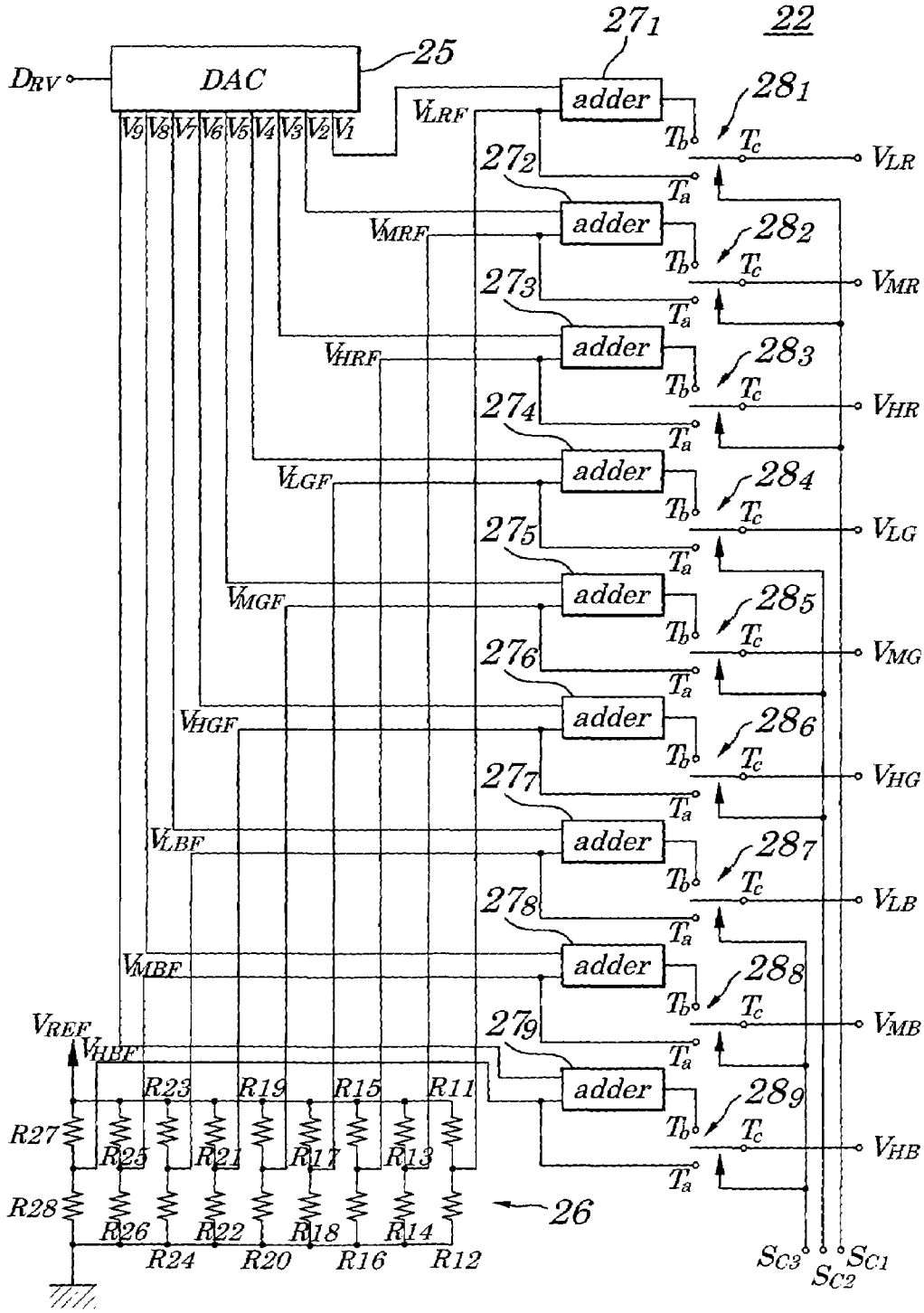
FIG. 3 is a block diagram showing an example of an electrical configuration of a reference voltage generating circuit in the driving circuit for the color liquid display of the first embodiment.

Next, FIG. 3 is an example of an electric configuration of the reference voltage generating circuit 22. The reference voltage generating circuit 22 is mainly provided with a DAC 25, a reference voltage supply source 26, adder $\mathbf{27}_1$ to adder $\mathbf{27}_9$ and switch $\mathbf{28}_1$ to switch $\mathbf{28}_9$.

The DAC 25 converts the reference voltage change data $D_{RV}$ supplied from the CPU (not shown) into analog change voltage $V_1$ to analog voltage $V_9$ and then respectively supplies analog change voltage $V_1$ to analog change voltage $V_9$ to each of first input terminals of adder $\mathbf{27}_1$ to adder $\mathbf{27}_9$. The reference voltage supply source 26 is configured by connecting in parallel a pair of a resistor R11 and a resistor R12 lengthwise connected, a pair of a resistor R13 and a resistor R14 lengthwise connected, a pair of a resistor R15 and a resistor R16 lengthwise connected, a pair of a resistor R17 and a resistor R18 lengthwise connected, a pair of a resistor R19 and a resistor R20 lengthwise connected, a pair of a resistor R21 and a resistor 22 lengthwise connected, a pair of a resistor R23 and a resistor R24 lengthwise connected, a pair of a resistor R25 and a resistor R26 lengthwise connected, and a pair of a resistor R27 and a resistor R28 lengthwise connected and by inserting these pairs between the reference voltage $V_{REF}$ and ground. Nine voltages generating at connection points of nine pairs of resistors in parallel are respectively supplied to second input terminals of the adder $\mathbf{27}_1$ through the $\mathbf{27}_9$ as a fixed reference voltage $V_{LRF}$, a fixed reference voltage $V_{MRF}$, a fixed reference voltage $V_{HRF}$, a fixed reference voltage $V_{LGP}$, a fixed reference voltage $V_{MGF}$, a fixed reference voltage $V_{HGF}$, a fixed reference voltage $V_{LBF}$, a fixed reference voltage $V_{MBF}$, a fixed reference voltage $V_{HBF}$, and are respectively applied to first selection terminals Ta of switch $\mathbf{28}_1$ to switch $\mathbf{28}_9$.

Adder $\mathbf{27}_1$ to adder $\mathbf{27}_9$ respectively add the analog change voltage $V_1$ to analog change voltage $V_9$ supplied from the corresponding first input terminals Ta to the fixed reference voltage $V_{LRF}$, the fixed reference voltage $V_{MRF}$, the fixed reference voltage $V_{HRF}$, the fixed reference voltage $V_{LGF}$, the fixed reference voltage $V_{MGF}$, the fixed reference voltage $V_{HGF}$, the fixed reference voltage $V_{LBF}$, to the fixed reference voltage $V_{MBF}$, and the fixed reference voltage $V_{HBF}$ and respectively apply an addition result ($V_{LRF}+V_1$), an addition result ($V_{MRF}+V_2$), an addition result ($V_{HRF}+V_3$), an addition result ($V_{LGF}+V_4$), an addition result ($V_{MGF}+V_5$), an addition result ($V_{HGF}+V_6$), an addition result ($V_{LBF}+V_7$), an addition result ($V_{MBF}+V_8$) and an addition result ($V_{HBF}+V_9$) (which are not shown) to second selection terminals Tb of switch $\mathbf{28}_1$ to switch $\mathbf{28}_9$ so as to be corresponded.

Figure 4:
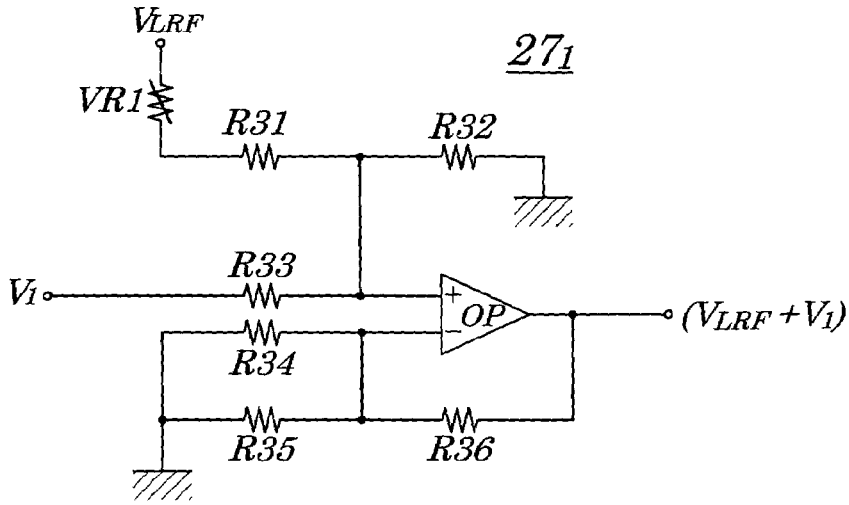
FIG. 4 is a schematic circuit diagram showing an example of an electrical configuration of an adder in the reference voltage generating circuit of the first embodiment.

Next, FIG. 4 shows an example of an electrical configuration of the adder $\mathbf{27}_1$. The adder $\mathbf{27}_1$ is manly provided with a variable resistor VR1, resistor R31 to resistor R36 having a same resistance value and an operational amplifier OP. In addition, adder $\mathbf{27}_2$ to adder $\mathbf{27}_9$ are approximately similar to the adder $\mathbf{27}_1$ concerning the electrical configuration and operation except that supplied fixed reference voltage and change voltage are different, therefore, explanations thereof will be omitted.

Each of switch $\mathbf{28}_1$ to switch $\mathbf{28}_9$ is switched from a common terminal Tc to the first selection terminal Ta or the selection terminal Tb based on a control signal $S_{C1}$, a control signal $S_{C2}$ or a control signal $S_{C3}$ supplied from the CPU (not shown) and supply the fixed reference voltage $V_{LRF}$, the fixed reference voltage $V_{MRF}$, the fixed reference voltage $V_{HRF}$, the fixed reference voltage $V_{LGF}$, the fixed reference voltage $V_{MGF}$, the fixed reference voltage $V_{HGF}$, the fixed reference voltage $V_{LBF}$, the fixed reference voltage $V_{MBF}$ and the fixed reference voltage $V_{HBF}$ or the addition result ($V_{LRF}+V_1$), the addition result ($V_{MRF}+V_2$), the addition result ($V_{HRF}+V_3$), the addition result ($V_{LGF}+V_4$), the addition result ($V_{MGF}+V_5$), the addition result ($V_{HGF}+V_6$), the addition result ($V_{LBF}+V_7$), the addition result ($V_{MBF}+V_8$)

and the addition result ($V_{HBF}+V_9$) which are not shown, as the reference voltage $V_{LR}$, the reference voltage $V_{MR}$, the reference voltage $V_{HR}$, the reference voltage $V_{LG}$, the reference voltage $V_{MG}$, the reference voltage $V_{HG}$, the reference voltage $V_{LB}$, the reference voltage $V_{MB}$ and the reference voltage $V_{HB}$ to gamma compensating circuit $\mathbf{21}_1$ to gamma compensating circuit $\mathbf{21}_3$.

Next, explanations will be given of operations of gamma compensating circuit $\mathbf{21}_1$ to gamma compensating circuit $\mathbf{21}_3$ and the reference voltage generating reference circuit 22 which has features of the present invention in operations of the above-mentioned driving circuit for the color liquid crystal display 1 with reference to FIG. 5.

Figure 5:
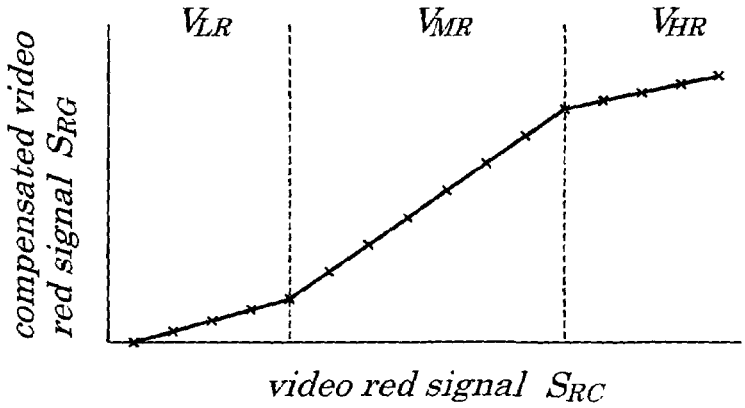
FIG. 5 is a graph showing an example of a relationship between a reference voltage $V_{LR}$, a reference voltage $V_{MR}$ and a reference voltage $V_{HR}$ used for applying gamma compensation to a video red signal $S_{RC}$ and a compensated video red signal $S_{RG}$ to which gamma compensation is applied in the first embodiment.

FIG. 5 is a graph showing an example of a relationship between the reference voltage $V_{LR}$, the reference voltage $V_{MR}$ and the reference voltage $V_{HR}$ used to apply the gamma compensation to the video red signal $S_{RG}$ and a gamma compensated video red signal $S_{RC}$. First, the reference voltage $V_{LR}$ is set near a minimum voltage value (a black level) of the video red signal $S_{RC}$, the reference voltage $V_{HR}$ is set near a maximum voltage value (a white level) of the video red signal $S_{RC}$ and the reference voltage $V_{MR}$ is set at a half-tone (gray) of the video red signal $S_{RC}$. In particular, concerning the reference voltage $V_{HR}$, for example, when the color liquid crystal display 1 has a V-T characteristic shown in FIG. 22 (curve a), the reference voltage $V_{HR}$ is set to 1.0 V so as to obtain a maximum transmittance T (maximum luminance) instead of 1.7 V of the conventional voltage, and, for example, when the color liquid crystal display 1 has a V-T characteristic shown in FIG. 24 (curve a), the reference voltage VHR is set to 1.0 V so as to obtain a maximum transmittance T (maximum luminance).

Figure 22:
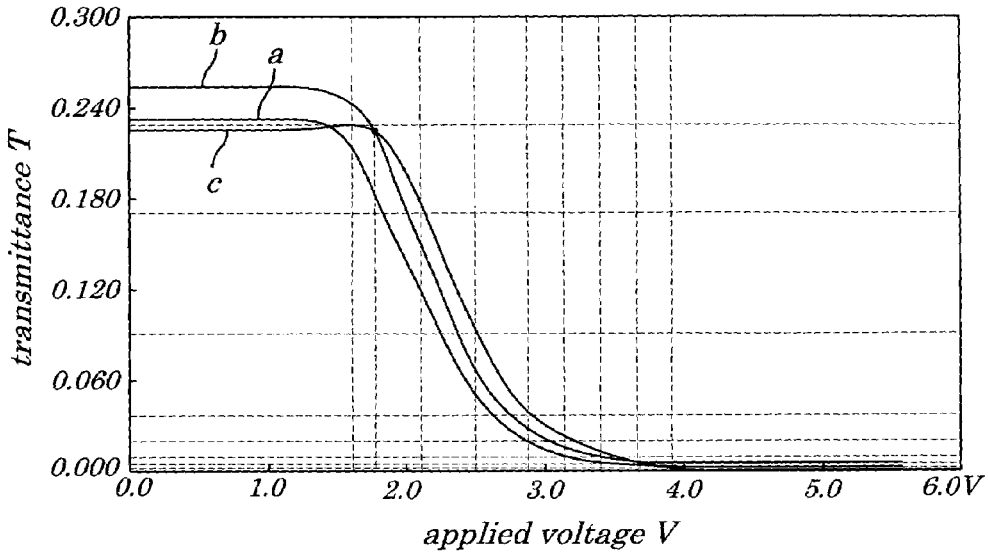
FIG.22 (PRIOR ART)
FIG. 22 is a graph showing an example of a V-T characteristic curve in the conventional color liquid crystal display.
Figure 23:
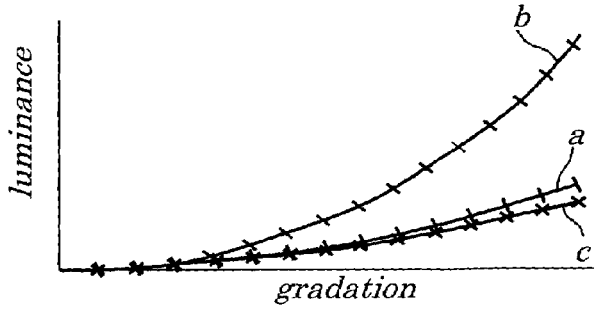
FIG.23 (PRIOR ART)
FIG. 23 is a graph showing an example of a gamma characteristic curve in the conventional color liquid crystal display.
Figure 24:
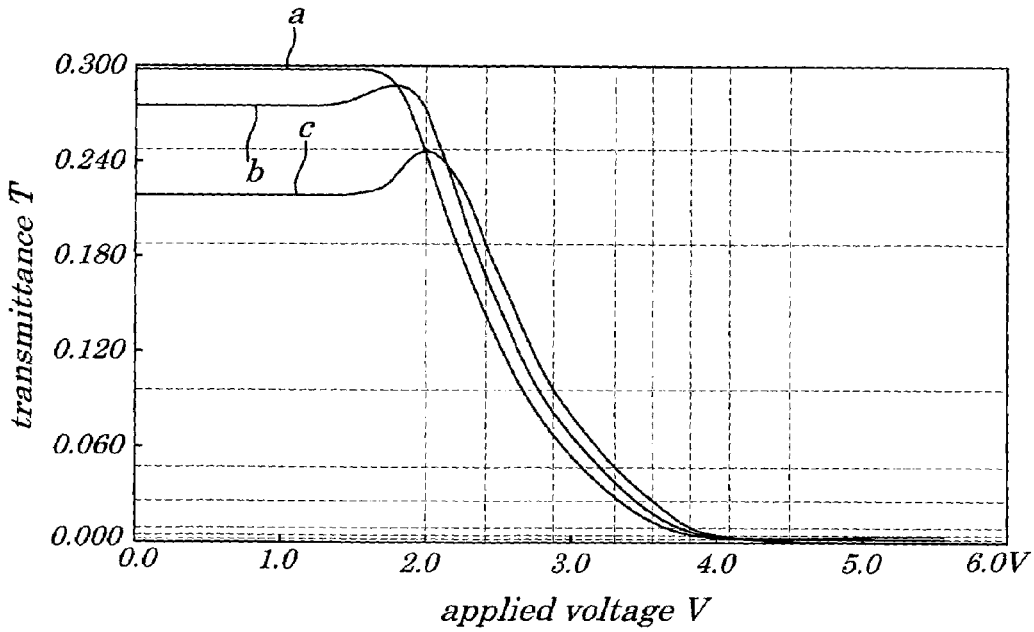
FIG.24 (PRIOR ART)
FIG. 24 is a graph showing another example of a V-T characteristic curve in the conventional color liquid crystal display.

In addition, the reference voltage $V_{LG}$, the reference voltage $V_{MG}$ and the reference voltage $V_{HG}$ for applying the gamma compensation to the video green signal $S_{GC}$ and the reference voltage $V_{LB}$, the reference voltage $V_{MB}$ and the reference voltage $V_{HB}$ for applying the gamma compensation to the video blue signal $S_{BC}$ are set so that an area from a minimum luminance (a minimum transmittance) to a maximum transmittance of a corresponding V-T characteristic can be fully used. In other words, for example, when the color liquid crystal display 1 has the V-T characteristic as shown in FIG. 22 (curve b), the reference voltage $V_{LG}$ is set to approximately 1.0 V in order to obtain a maximum transmittance (a maximum luminance) instead of approximately 1.7 V of the conventional voltage, and when the color liquid crystal display 1 has a V-T characteristic as shown in FIG. 24 (curve b), the reference voltage $V_{LG}$ is set to approximately 1.8 V in order to obtain a maximum transmittance (a maximum luminance, a peak point). Similarly, for example, when the color liquid crystal display 1 has a V-T characteristic as shown in FIG. 22 (curve c), the reference voltage $V_{LB}$ is set to approximately 1.5 V in order to obtain a maximum transmittance (a maximum luminance) instead of approximately 1.7 V of the conventional voltage, and when the color liquid crystal display 1 has a V-T characteristic as shown in FIG. 24 (curve c), the reference voltage $V_{LB}$ is set to approximately 2.0 V in order to obtain a maximum transmittance (a maximum luminance, a peak point).

In brief, the first embodiment is characterized in that each difference among a red V-T characteristic, a green V-T characteristic and a blue V-T characteristic in the color liquid crystal display 1 is considered and the reference voltage $V_{LR}$, the reference voltage $V_{MR}$, the reference voltage $V_{HR}$, the reference voltage $V_{LG}$, the reference voltage $V_{MG}$, the reference voltage $V_{HG}$, the reference voltage $V_{LB}$, the reference voltage $V_{MB}$, and the reference voltage $V_{HB}$ are set so that a range from a maximum luminance to a minimum luminance of each V-T characteristic can be fully used.

Next, for example, when a non-active control signal $S_{C1}$ is supplied from the CPU (not shown), the common terminals Tc of switch $\mathbf{28}_1$ to switch $\mathbf{28}_3$ shown in FIG. 3 are connected to the first selection terminals Ta, therefore, the fixed reference voltage $V_{LRF}$, the fixed reference voltage $V_{MRF}$ and the fixed reference voltage $V_{HRF}$ supplied from the reference voltage supply source 26 are directly supplied to the gamma compensating circuit $\mathbf{21}_1$ shown in FIG. 1 as the reference voltage $V_{LR}$, the reference voltage $V_{MR}$ and the reference voltage $V_{HR}$. With this operation, the gamma compensation including the first gamma compensation and the second gamma compensation is applied to the video red signal $S_{RC}$ based on the reference voltage $V_{LR}$, the reference voltage $V_{MR}$ and the reference voltage $V_{HR}$ in the gamma compensating circuit $\mathbf{21}_1$ independently of the video green signal $S_{GC}$ and the video blue signal $S_{BC}$, and thereby a gradient is given. Then, the video red signal $S_{RC}$ is output as a video red signal $S_{RG}$.

In addition, please refer to Japanese Patent Application Laid-open No. Hei 6-205340 disclosing details of the operation of the gamma compensating circuit $\mathbf{21}_1$.

Similarly, for example, when a non-active control signal $S_{C2}$ is supplied from the CPU (not shown), the common terminals Tc of switch $\mathbf{28}_4$ to switch $\mathbf{28}_6$ shown in FIG. 3 are connected to the first selection terminals Ta, therefore, the fixed reference voltage $V_{LGF}$, the fixed reference voltage $V_{MGF}$ and the fixed reference voltage $V_{HGF}$ supplied from the reference voltage supply source 26 are directly supplied to the gamma compensating circuit $\mathbf{21}_2$ shown in FIG. 1 as the reference voltage $V_{LG}$, the reference voltage $V_{MG}$ and the reference voltage $V_{HG}$. With this operation, the gamma compensation including the first gamma compensation and the second gamma compensation is applied to the video green signal $S_{GC}$ based on the reference voltage $V_{LG}$, the reference voltage $V_{MG}$ and the reference voltage $V_{HG}$ in the gamma compensating circuit $\mathbf{21}_2$ independently of the video red signal $S_{RC}$ and the video blue signal $S_{BC}$, and thereby a gradient is given. Then, the video green signal $S_{GC}$ is output as a video green signal $S_{GG}$.

Similarly, for example, when a non-active control signal $S_{C3}$ is supplied from the CPU (not shown), the common terminals Tc of switch $\mathbf{28}_7$ to switch $\mathbf{28}_9$ shown in FIG. 3 are connected to the first selection terminal Ta, therefore, the fixed reference voltage $V_{LBF}$, the fixed reference voltage $V_{MBF}$ and the fixed reference voltage $V_{HBF}$ supplied from the reference voltage supply source 26 are directly supplied to the gamma compensating circuit $\mathbf{21}_3$ shown in FIG. 1 as the reference voltage $V_{LB}$, the reference voltage $V_{MB}$ and the reference voltage $V_{HB}$. With this operation, the gamma compensation including the first gamma compensation and the second gamma compensation is applied to the video blue signal $S_{BC}$ based on the reference voltage $V_{LB}$, the reference voltage $V_{MB}$ and the reference voltage $V_{HB}$ in the gamma compensating circuit $\mathbf{21}_3$ independently of the video red signal $S_{RC}$ and the video green signal $S_{GC}$, and thereby a gradient is given. Then, the video blue signal $S_{BC}$ is output as a video blue signal $S_{BG}$.

As another case, for example, when an active control signal $S_{C1}$ and a reference voltage change data $D_{RV}$ are supplied from the CPU (not shown), the DAC 25 converts the reference voltage change data $D_{RV}$ into analog change voltage $V_1$ to analog change voltage $V_9$ and supplies to respective input terminal of adder $\mathbf{27}_1$ to adder $\mathbf{27}_9$. With this operation, each of adder $\mathbf{27}_1$ to adder $\mathbf{27}_3$ adds each of the fixed reference voltage $V_{LRF}$, the fixed reference voltage $V_{MRF}$, the fixed reference voltage $V_{HRF}$ supplied to the corresponding first input terminal to each of change voltage $V_1$ to change voltage $V_3$ supplied to the corresponding second input terminal and applies each of the addition result ($V_{LRF}+V_1$), the addition result ($V_{MRF}+V_2$) and the addition result ($V_{HRF}+V_3$), to each of the second selection terminals Tb of switch $\mathbf{28}_1$ to switch $\mathbf{28}_3$. Further, since the common terminal Tc of switch $\mathbf{28}_1$ to switch $\mathbf{28}_3$ are connected to the second selection terminal Tb, the addition result ($V_{LRF}+V_1$), the addition result ($V_{MRF}+V_2$) and the addition result ($V_{HRF}+V_3$) are supplied to the gamma compensating circuit $\mathbf{21}_1$ as the reference voltage $V_{LR}$, the reference voltage $V_{MR}$ and the reference voltage $V_{HR}$. With this operation, the gamma compensation including the first gamma compensation and the second gamma compensation is applied to the video red signal $S_{RC}$, in the gamma compensating circuit $\mathbf{21}_1$ based on the reference voltage $V_{LR}$, the reference voltage $V_{MR}$, the reference voltage $V_{HR}$ which are finely adjusted in order to change a change quantity (incline) of a voltage level of the video red signal $S_{RG}$ for the reference voltage $V_{LR}$, the reference voltage $V_{MR}$ and the reference voltage $V_{HR}$ independently of the video green signal $S_{GC}$ and the video blue signal $S_{BC}$, and thereby a gradient is given. Then, the video red signal $S_{RC}$ is output as a video red signal $S_{RG}$.

Similarly, for example, when an active control signal $S_{C2}$ and a reference voltage change data $D_{RV}$ are supplied from the CPU (not shown), the DAC 25 converts the reference voltage change data $D_{RV}$ into analog change voltage $V_1$ to analog change voltage $V_9$ and supplies them to respective input terminals of adder $\mathbf{27}_1$ to adder $\mathbf{27}_9$. With this operation, each of adder $\mathbf{27}_4$ to adder $\mathbf{27}_6$ adds each of the fixed reference voltage $V_{LGF}$, the fixed reference voltage $V_{MGF}$ and the fixed reference voltage $V_{HGF}$ supplied to the corresponding first input terminal to each of change voltage $V_4$ to change voltage $V_6$ supplied to the corresponding second input terminal and applies each of the addition result ($V_{LGF+}V_4$), the addition result ($V_{MGF}+V_5$) and the addition result ($V_{HGF}+V_6$) to each of the second selection terminals Tb of switch $\mathbf{28}_4$ to switch $\mathbf{28}_6$. Further, since the common terminals Tc of switch $\mathbf{28}_4$ to switch $\mathbf{28}_6$ are connected to the second selection terminal Tb, the addition result ($V_{LGF}+V_4$), the addition result ($V_{MGF}+V_5$) and the addition result ($V_{HGF}+V_6$) are supplied to the gamma compensating circuit $\mathbf{21}_2$ as the reference voltage $V_{LG}$, the reference voltage $V_{MG}$ and the reference voltage $V_{HG}$. With this operation, the gamma compensation including the first gamma compensation and the second gamma compensation is applied to the video green signal $S_{GC}$ in the gamma compensating circuit $\mathbf{21}_2$ based on the reference voltage $V_{LG}$, the reference voltage $V_{MG}$ and the reference voltage $V_{HG}$ which are finely adjusted in order to a change quantity (incline) of a voltage level of the video green signal $S_{GC}$ to the reference voltage $V_{LG}$, the reference voltage $V_{MG}$ and the reference voltage $V_{HG}$ independently of the video red signal $S_{RC}$ and the video blue signal $S_{BC}$, and thereby a gradient is given. Then, the video green signal $S_{GC}$ is output as a video green signal $S_{GG}$.

Similarly, for example, when an active control signal $S_{C3}$ and a reference voltage change data $D_{RV}$ are supplied from the CPU (not shown), the DAC 25 converts the reference voltage change data $D_{RV}$ into analog change voltage $V_1$ to analog change voltage $V_9$ and supplies to respective input terminals of adder $\mathbf{27}_1$ to adder $\mathbf{27}_9$. With this operation, each of adder $\mathbf{27}_7$ to adder $\mathbf{27}_9$ adds each of the fixed reference voltage $V_{LBF}$, the fixed reference voltage $V_{MBF}$ and the fixed reference voltage $V_{HBF}$ supplied to the corresponding first input terminal to each of change voltage $V_7$ to change voltage $V_9$ supplied to the corresponding second input terminal and applies each of the addition result ($V_{LBF}+V_7$), the addition result ($V_{MBF}+V_8$) and the addition result ($V_{HBF}+V_9$), each of the second selection terminals Tb of switch $\mathbf{28}_7$ to switch $\mathbf{28}_9$. Further, since the common terminals Tc of switch $\mathbf{28}_7$ to switch $\mathbf{28}_9$ are connected to the second selection terminals Tb, the addition result ($V_{LBF}+V_7$), the addition result ($V_{MBF}+V_8$) and the addition result ($V_{HBF}+V_9$) are supplied to the gamma compensating circuit $\mathbf{21}_3$ as the reference voltage $V_{LB}$, the reference voltage $V_{MB}$ and the reference voltage $V_{HB}$. With this operation, the gamma compensation including the first gamma compensation and the second gamma compensation is applied to the video blue signal $S_{BC}$ in the gamma compensating circuit $\mathbf{21}_3$ based on the reference voltage $V_{LB}$, the reference voltage $V_{MB}$ and the reference voltage $V_{HB}$ which are finely adjusted in order to change a change quantity (incline) of a voltage level of the video red signal $S_{RG}$ to the reference voltage $V_{LG}$, the reference voltage $V_{MB}$ and the reference voltage $V_{HB}$ independently of the video red signal $S_{RC}$ and the video green signal $S_{GC}$, and thereby a gradient is given. Then, the video blue signal $S_{BC}$ is output as a video blue signal $S_{BG}$.

As above described, in the first embodiment, in gamma compensating circuit $\mathbf{21}_1$ to gamma compensating circuit $\mathbf{21}_3$, each range from a maximum luminance to a minimum luminance of each of the red V-T characteristic, the green V-T characteristic and the blue V-T characteristic in the color liquid crystal display 1 are fully considered, the gamma compensation is independently applied to the video red signal $S_{RC}$, the video green signal $SR_{GC}$ and the video blue signal $S_{BC}$ based on the reference voltage $V_{LR}$, the reference voltage $V_{MR}$, the reference voltage $V_{HR}$, the reference voltage $V_{LG}$, the reference voltage $V_{MG}$, the reference voltage $V_{HG}$, the reference voltage $V_{LB}$, the reference voltage $V_{MB}$ and the reference voltage $V_{HB}$ which are fixed or finely adjusted, and a gradient is given. Accordingly, an optimal gamma compensation can be carried out and a reproduced image of a good gradation can be obtained. As a result, it is possible to meet a recent request of a high quality image. Furthermore, it is fully available to the color liquid crystal display 1 having a V-T characteristic of a high transmittance shown in FIG. 24.

In addition, when a gradation batter occurs in a specific color among red, green and blue, the CPU (not shown) supplies reference voltage change data for changing reference voltage (any one of the reference voltage $V_L$, the reference voltage $V_M$ and the reference voltage $V_H$) corresponding to a color range in which the gradation batter occurs (near the white level, near gray or near the black level) and the active control signal $S_{C1}$ to the reference voltage generating circuit 22, and thereby this gradation batter can be removed.

Second Embodiment

Next, explanations will be given of the second embodiment according to the present invention.

FIG. 6 is a block diagram showing an electrical configuration of a driving circuit for the color liquid crystal display 1 according to the second embodiment of the present invention. In FIG. 6, same numerals are given to corresponding parts in FIG. 1 and the explanations thereof are omitted. In the driving circuit for the color liquid crystal display 1 shown in FIG. 6, instead of the reference voltage generating circuit 22 shown in FIG. 1, a reference voltage generating circuit 31 is provided.

Figure 7:
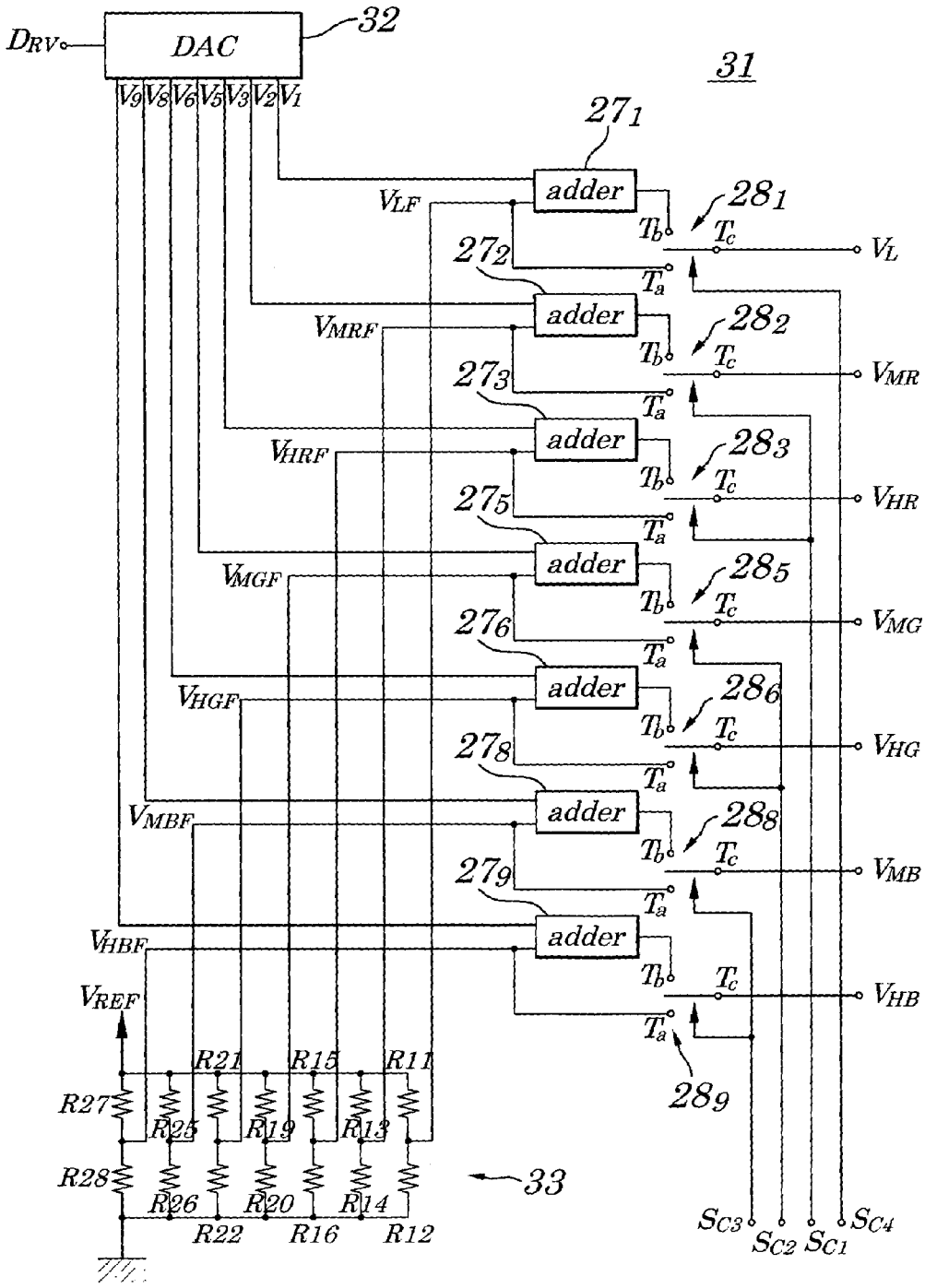
FIG. 7 is a block diagram showing an example of an electrical configuration of a reference voltage generating circuit in the driving circuit for the color liquid crystal display of the second embodiment.

FIG. 7 is a block diagram showing one example of an electrical configuration of the reference voltage generating circuit 31. In FIG. 7, same numerals are given to corresponding parts in FIG. 3 and the explanations thereof are omitted. In the reference voltage generating circuit 31 shown in FIG. 7, instead of the DAC 25 and the reference voltage supply source 26 shown in FIG. 3, a DAC 32 and a reference voltage supply source 33 are provided.

The DAC 32 converts a reference voltage change data $D_{RV}$ supplied from a CPU (not shown) into an analog change voltage $V_1$, an analog change voltage $V_2$, an analog change voltage $V_3$, an analog change voltage $V_5$, an analog change voltage $V_6$, an analog change voltage $V_8$ and an analog change voltage $V_9$ and supplies them to respective first input terminals of an adder $\mathbf{27}_1$, an adder $\mathbf{27}_2$, an adder $\mathbf{27}_3$, an adder $\mathbf{27}_5$, an adder $\mathbf{27}_6$, an adder $\mathbf{27}_8$ and an adder $\mathbf{27}_9$. In the reference voltage supply source 33, an resistor R17 and an resistor R18 lengthwise connected and an resistor R23 and an resistor R24 lengthwise connected are removed from the reference voltage supply source 26 shown in FIG. 3. Seven voltages generating at connection points of seven pairs of resistors lengthwise connected are respectively supplied to second input terminals of the adder $\mathbf{27}_1$, the adder $\mathbf{27}_2$, the adder $\mathbf{27}_3$, the adder $\mathbf{27}_5$, the adder $\mathbf{27}_6$, the adder $\mathbf{27}_8$ and the adder $\mathbf{27}_9$ as a fixed reference voltage $V_{LF}$, a fixed reference voltage $V_{MRF}$, a fixed reference voltage $V_{HRF}$, a fixed reference voltage $V_{MGF}$, a fixed reference voltage $V_{HGF}$, a fixed reference voltage $V_{MBF}$, a fixed reference voltage $V_{HBF}$ and are applied to respective first selection terminals Ta of a switch $\mathbf{28}_1$, a switch $\mathbf{28}_2$, a switch $\mathbf{28}_3$, a switch $\mathbf{28}_5$, a switch $\mathbf{28}_6$, a switch $\mathbf{28}_8$ and a switch $\mathbf{28}_9$.

Further, in the reference voltage generating circuit 31 shown in FIG. 7, an adder $\mathbf{27}_4$ and an adder $\mathbf{27}_7$ and an switch $\mathbf{28}_4$ and an switch $\mathbf{28}_7$ shown in FIG. 3 are removed, and a control signal $S_{C4}$ is supplied from the CPU (not shown) to the switch $\mathbf{28}_1$.

Next, in the second embodiment, reasons are given of the above-mentioned configuration. As understood from FIG. 22 and FIG. 24, there are differences in a range in which a transmittance T is high concerning each of a red V-T characteristics, a green V-T characteristic and a blue V-T characteristic in the color liquid crystal display 1, however, there is little difference in a range in which the transmittance T is low. So, in the second embodiment, in order to reduce a circuit scale, as gamma compensation for the video red signal $S_{RC}$, gamma compensation for the video green signal $S_{GC}$ and gamma compensation for the video blue signal $S_{BC}$ corresponding to the range in which the transmittance T is low, a similar gamma compensation is applied to the video red signal $S_{RC}$, the video green signal $S_{GC}$ and the video blue signal $S_{BC}$ using a common reference voltage $V_L$. In addition, it is assumed that gamma compensation in the second embodiment includes a first gamma compensation and a second gamma compensation.

Further, operations are similar to those of the first embodiment except the gamma compensation using the common reference voltage $V_L$, therefore, explanations thereof are omitted.

As above described, according to the second embodiment, in the range in which there is no difference of the V-T characteristic and the transmittance T is low, the gamma compensation is applied using the common reference voltage $V_L$ in order to give a gradient, therefore, a circuit scale can be reduced in addition to effects obtained from the configuration according to the first embodiment.

Third Embodiment

Next, explanations will be given of the third embodiment of the present invention.

Figure 8:
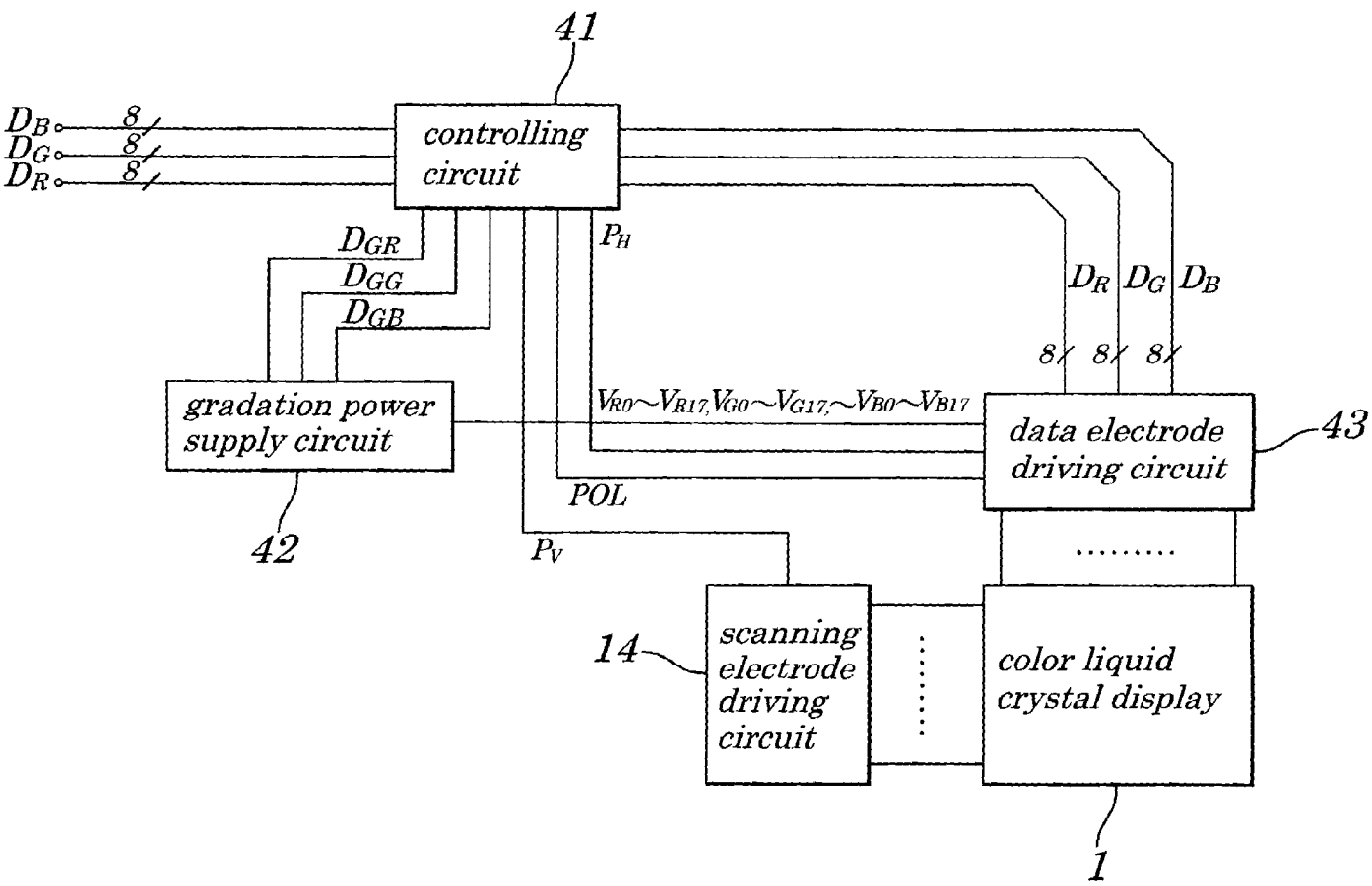
FIG. 8 is a block diagram showing an electrical configuration of a driving circuit for a color liquid crystal display according a third embodiment of the present invention.

FIG. 8 is a block diagram showing an electrical configuration of a driving circuit of a digital circuit configuration for a color liquid crystal display 1 according to the third embodiment of the present invention. In FIG. 8, same numerals are given to corresponding parts in FIG. 20 and the explanations thereof are omitted.

Figure 20:
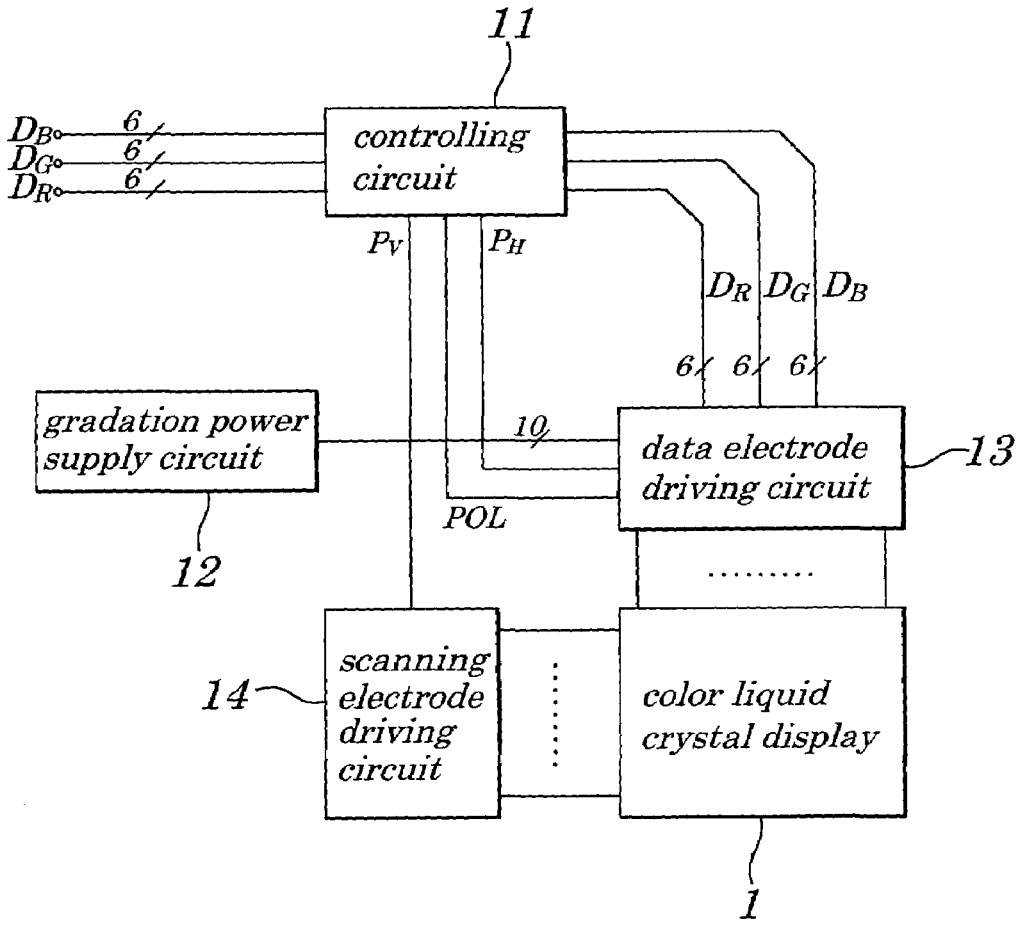
FIG.20 (PRIOR ART)
FIG. 20 a block diagram showing a second conventional example of an electrical configuration of a driving circuit for a color liquid crystal display.
Figure 21:
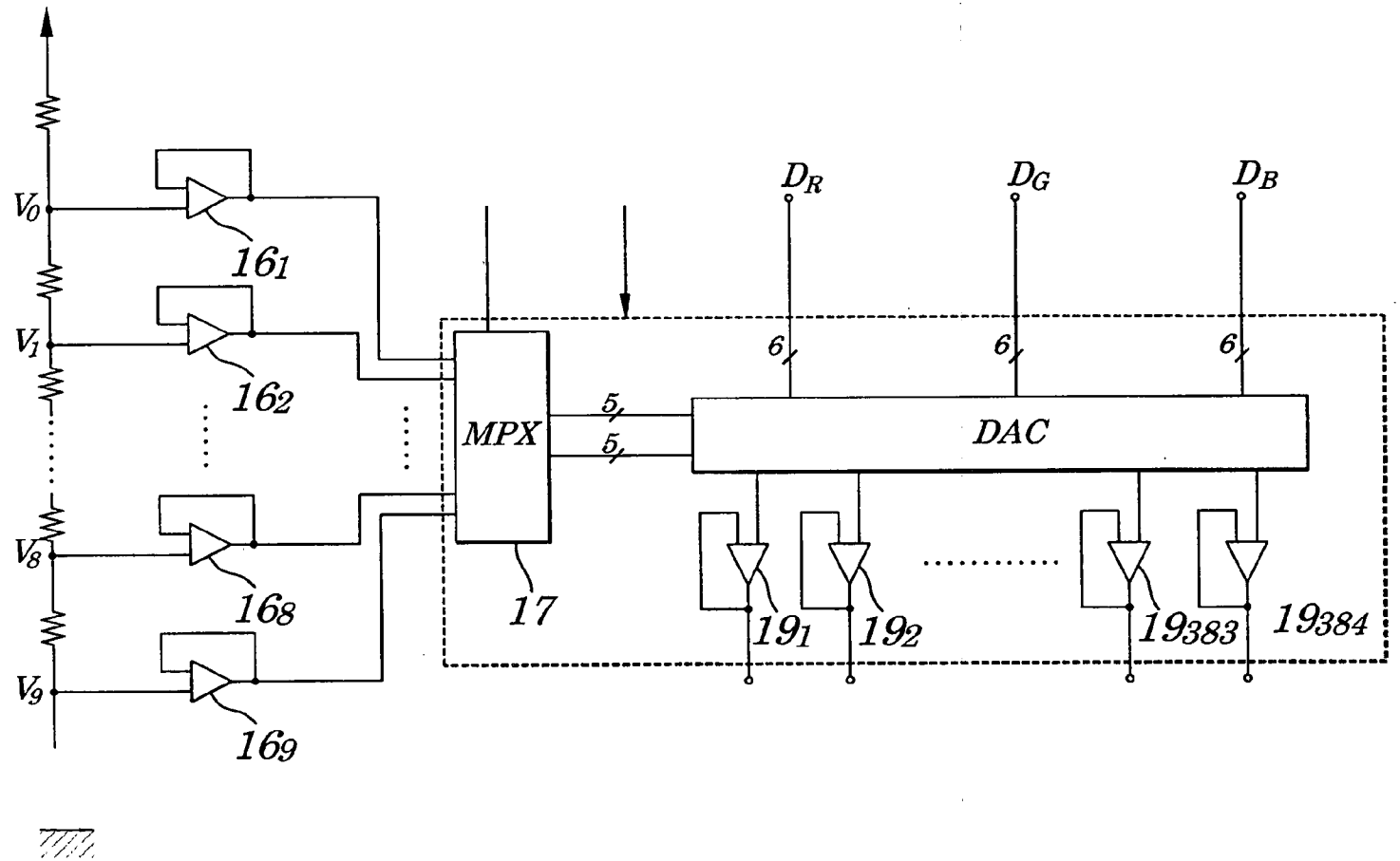
FIG.21 (PRIOR ART)
FIG. 21 is a schematic block diagram showing an electrical configuration of a gradation power supply circuit and a data electrode driving circuit in the driving circuit for the conventional color liquid crystal display.

In the driving circuit for the color liquid crystal display 1 shown in FIG. 8, instead of a controlling circuit 11, a gradation power supply circuit 12 and a data electrode driving circuit 13 shown in FIG. 20, a controlling circuit 41, a gradation power supply circuit 42 and a data electrode driving circuit 43 are provided.

The controlling circuit 41 is, for example, an ASIC, and supplies red data $D_R$ of eight bits, green data $D_G$ of eight bits, blue data $D_B$ of eight bits supplied from outside to the data electrode driving circuit 43 and generates a polarity inverting pulse POL for alternately driving a horizontal scanning pulse $P_H$, a vertical scanning pulse $P_V$ and the color liquid crystal display 1 to supply the polarity inverting pulse POL to the data electrode driving circuit 43 and a scanning electrode driving circuit 14. Further, the controlling circuit 41 independently applies gamma compensation to the red data $D_R$, the green data $D_G$ and the blue data $D_B$, and thereby supplies red gradation voltage data $D_{GR}$, green gradation voltage data $D_{GG}$ and blue gradation voltage data $D_{GB}$ to the gradation power supply circuit 42. In addition, it is assumed that the gamma compensation in the third embodiment includes a first gamma compensation and a second gamma compensation.

Figure 9:
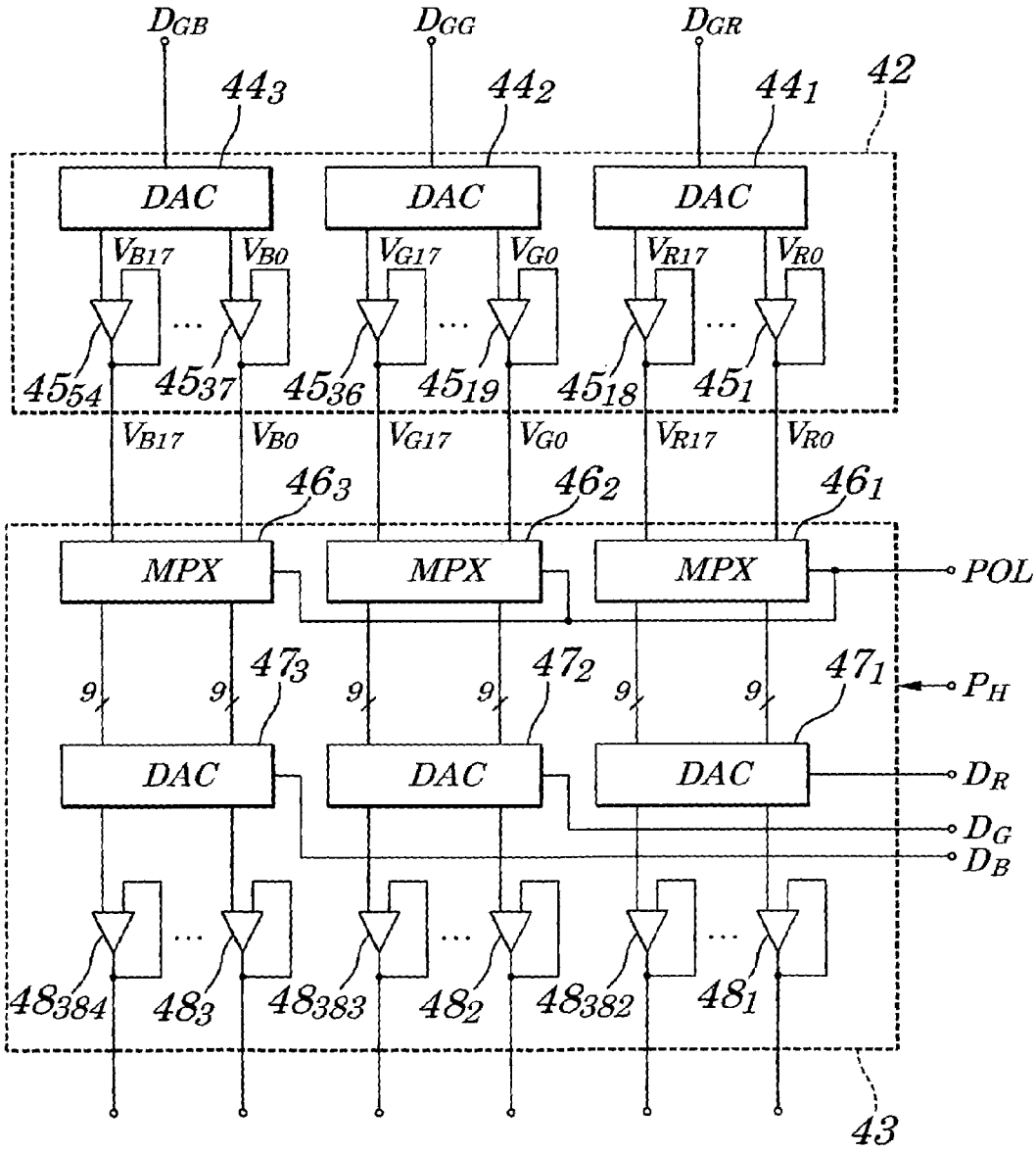
FIG. 9 is a block diagram showing an example of an electrical configuration of a gradation power supply circuit and a data electrode driving circuit for the liquid crystal display in the driving circuit of the third embodiment.

The gradation power supply circuit 42, as shown in FIG. 9, is mainly provided with a DAC $\mathbf{44}_1$, a DAC $\mathbf{44}_2$ and a DAC $\mathbf{44}_3$ and voltage follower $\mathbf{45}_1$ to voltage follower $\mathbf{45}_{54}$. The DAC $\mathbf{44}_1$ converts the red gradation voltage data $D_{GR}$ supplied from the controlling circuit 41 into analog red gradation voltage $V_{R0}$ to analog red gradation voltage $V_{R17}$ and supplies them to voltage follower $\mathbf{45}_1$ to voltage follower $\mathbf{45}_{18}$. Similarly, the DAC $\mathbf{44}_2$ converts the green gradation voltage data $D_{GG}$ supplied from the controlling circuit 41 into analog green gradation voltage $V_{G0}$ to analog green gradation voltage $V_{G17}$ and supplies them to voltage follower $\mathbf{45}_{19}$ to voltage follower $\mathbf{45}_{36}$. The DAC $\mathbf{44}_3$ converts the blue gradation voltage data $D_{GB}$ supplied from the controlling circuit 41 into analog blue gradation voltage $V_{B0}$ to analog blue gradation voltage $V_{B17}$ and supplies them to voltage follower $\mathbf{45}_{37}$ to voltage follower $\mathbf{45}_{54}$. Voltage follower $\mathbf{45}_1$ to voltage follower $\mathbf{45}_{54}$ applies buffer to red gradation voltage $V_{R0}$ to red gradation voltage $V_{R17}$, green gradation voltage $V_{G0}$ to green gradation voltage $V_{G17}$ and blue gradation voltage $V_{B0}$ to blue gradation voltage $V_{B17}$ for the gamma compensation and supplies them to the data electrode driving circuit 43.

The data electrode drive circuit 43, as shown in FIG. 9, is mainly provided with a MPX $\mathbf{46}_1$, a MPX $\mathbf{46}_2$ and a MPX $\mathbf{46}_3$, a DAC $\mathbf{47}_1$ of eight bits, a DAC $\mathbf{47}_2$ of eight bits and a DAC $\mathbf{47}_3$ of eight bits and voltage follower $\mathbf{48}_1$ to voltage follower $\mathbf{48}_{384}$. In addition, in a real data electrode driving circuit, a shift register, a data register, a latch, a level shifter and a like are provided at a front step of a DAC, however, there is no relationship between features of the present invention and these elements and operations, therefore, explanations thereof are omitted.

The MPX $\mathbf{46}_1$ switches a group of red gradation voltage $V_{R0}$ to red gradation voltage $V_{R8}$ over a group of red gradation voltage $V_{R9}$ to red gradation voltage $V_{R17}$ in red gradation voltage $V_{R0}$ to red gradation voltage $V_{R17}$, supplied from the gradation power supply circuit 42 based on the polarity inverting pulse POL supplied from the controlling circuit 41 and supplies any one of the groups to the DAC $\mathbf{47}_1$. Similarly, the MPX $\mathbf{46}_2$ switches a group of green gradation voltage $V_{G0}$ to green gradation voltage $V_{G8}$ over a group of green gradation voltage $V_{G9}$ to green gradation voltage $V_{G17}$ in green gradation voltage $V_{G0}$ to green gradation voltage $V_{G17}$, supplied from the gradation power supply circuit 42 based on the polarity inverting pulse POL supplied from the controlling circuit 41 and supplies any one of the groups to the DAC $\mathbf{47}_2$. The MPX $\mathbf{46}_3$ switches a group of blue gradation voltage $V_{B0}$ to blue gradation voltage $V_{B8}$ over a group of blue gradation voltage $V_{B9}$ to the blue gradation voltage $V_{B17}$ in blue gradation voltage $V_{B0}$ to blue gradation voltage $V_{B17}$ supplied from the gradation power supply circuit 42 based on the polarity inverting pulse POL supplied from the controlling circuit 41 and supplies any one of the groups to the DAC $\mathbf{47}_3$.

Figure 10:
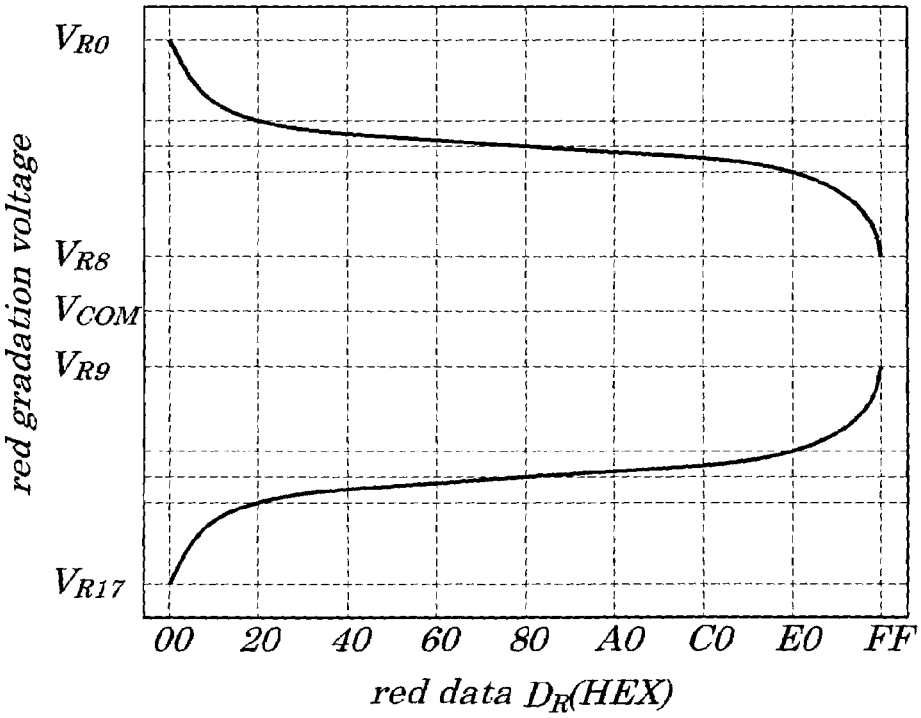
FIG. 10 is a graph showing an example of a relationship between red data of eight bits supplied to a DAC in the data electrode driving circuit and red gradation voltage $V_{R0}$ 2 to red gradation voltage $V_{R8}$ and red gradation voltage $V_{R9}$ to red gradation voltage $V_{R17}$ in the third embodiment.

The DAC $\mathbf{47}_1$, based on the group of red gradation voltage $V_{R0}$ to red gradation voltage $V_{R8}$ or the group of red gradation voltage $V_{R9}$ to red gradation voltage $V_{R17}$, applies the gamma compensation to the red data $D_R$ of eight bits supplied from the controlling circuit 41 so as to give a gradient to the red data $D_R$, converts the red data $D_R$ into an analog data red signal and then supplies the analog data red signal to voltage follower $\mathbf{48}_1$ to voltage follower $\mathbf{48}_{382}$. Here, FIG. 10 shows an example of a relationship between the red data $D_R$ (indicated by hexadecimal number (HEX)) of eight bits supplied to the DAC $\mathbf{47}_1$ and red gradation voltage $V_{R0}$ to red gradation voltage $V_{R8}$ or red gradation voltage $V_{R9}$ to red gradation voltage $V_{R17}$. As understood from FIG. 10, in order to apply the gamma compensation including the first gamma compensation and the second gamma compensation to the red data $D_R$ so as to give a gradient to the red data $D_R$, the group of red gradation voltage $V_{R0}$ to the red gradation voltage $V_{R8}$ or the group of red gradation voltage $V_{R9}$ to red gradation voltage $V_{R17}$ which has a nonlinear voltage value is supplied to the DAC $\mathbf{47}_1$.

Similarly, The DAC $\mathbf{47}_2$, based on the group of green gradation voltage $V_{G0}$ to green gradation voltage $V_{G8}$ or the group of green gradation voltage $V_{G9}$ to green gradation voltage $V_{G17}$, applies the gamma compensation to the green data $D_G$ of eight bits supplied from the controlling circuit 41 so as to give a gradient to the green data $D_G$, converts the green data $D_G$ into an analog data green signal and then supplies the analog data green signal to voltage follower $\mathbf{48}_{129}$ to voltage follower $\mathbf{48}_{256}$. Not shown, however, in order to apply the gamma compensation including the first gamma compensation and the second gamma compensation to the green data $D_G$ so as to give a gradient to the red data $D_G$, the group of green gradation voltage $V_{G0}$ to green gradation voltage $V_{G8}$ or the group of green gradation voltage $V_{G9}$ to green gradation voltage $VG_{G17}$ which has a nonlinear voltage value is supplied to the DAC $\mathbf{47}_2$.

Similarly, The DAC $\mathbf{47}_3$, based on the group of blue gradation voltage $V_{B0}$ to blue gradation voltage $V_{B8}$ or the group of blue gradation voltage $V_{B9}$ to blue gradation voltage $V_{B17}$, applies the gamma compensation to the blue data $D_B$ of eight bits supplied from the controlling circuit 41 so as to give gradient to the blue data $D_B$, converts the blue data $D_B$ into an analog data blue signal and then supplies the analog data blue signal to voltage follower $\mathbf{48}_{257}$ to voltage follower $\mathbf{48}_{384}$. Not shown, however, in order to apply the gamma compensation including the first gamma compensation and the second gamma compensation to the blue data $D_B$ so as to give a gradient to the blue data $D_B$, the group of blue gradation voltage $V_{B0}$ to blue gradation voltage $V_{B8}$ or the group of blue gradation voltage $V_{B9}$ to blue gradation voltage $VG_{B17}$ which has a nonlinear voltage value is supplied to the DAC $\mathbf{47}_3$.

Voltage follower $\mathbf{48}_1$, to voltage follower $\mathbf{48}_{384}$ apply buffer to the data red signal, the data green signal and the data blue signal supplied from DAC $\mathbf{47}_1$ to DAC $\mathbf{47}_3$ and apply these signals to corresponding data electrodes of the color liquid crystal display 1.

Next, explanations will be given of operations of the controlling circuit 41, the gradation power supply circuit 42 and the data electrode driving circuit 43 which are features of the present invention in operations of the driving circuit for the liquid crystal display 1.

First, the controlling circuit 41 supplies the red data DR of eight bits, the green data $D_G$ of eight bits and the blue data $D_B$ of eight bits supplied from the outside to the data electrode driving circuit 43 and supplies the red gradation voltage data $D_{GR}$, the green gradation voltage data $D_{GG}$ and the blue gradation voltage data $D_{GB}$ which are considered in order to fully use a range of the V-T characteristic from the minimum luminance to maximum luminance for each of red, green and blue in the color liquid crystal display 1 to the gradation power supply circuit 42. The gradation power supply circuit 42 analog-converts the red gradation voltage data $D_{GR}$, the green gradation voltage data $D_{GG}$ and the blue gradation voltage data $D_{GB}$, and then applies buffer to these data and supplies them to the data electrode driving circuit 43 as red gradation voltage $V_{R0}$ to red gradation voltage $V_{R17}$, green gradation voltage $V_{G0}$ to green gradation voltage $V_{G17}$ and blue gradation voltage $V_{B0}$ to blue gradation voltage $V_{B17}$.

Accordingly, the data electrode driving circuit 43, based on the group of red gradation voltage $V_{R0}$ to red gradation voltage $V_{R8}$ or the group of red gradation voltage $V_{R9}$ to red gradation voltage $V_{R17}$, the group of green gradation voltage $V_{G0}$ to the green gradation voltage $V_{G8}$ or the group of green gradation voltage $V_{G9}$ to green gradation voltage $V_{G17}$ and the group of blue gradation voltage $V_{B0}$ to blue gradation voltage $V_{B8}$ or the group of blue gradation voltage $V_{B9}$ to blue gradation voltage $V_{B17}$, applies the gamma compensation to the red data $D_R$ of eight bits, the green data $D_G$ of eight bits and the blue data $D_B$ of eight bits so as to give gradient to these data and analog-converts the data red signal, the data green signal and the data blue signal and then applies these signals to the corresponding data electrodes in the color liquid crystal display 1 after applying buffer.

As above described, according to the third embodiment, approximately similar effects of the first embodiment can be obtained, that is, in digital circuit configuration, it is possible to give a gradient by applying an optimal gamma compensation, to obtain a reproduced image of fine gradation and to use the color liquid crystal display 1 fully even if it has a V-T characteristic of a high transmittance.

Further, when a gradation batter occurs in a specific color among red, green and blue, the controlling circuit 41 supplies the gradation voltage data $D_G$ changed in order to change a gradation voltage (any one of the gradation voltage $V_0$ to the gradation voltage $V_{17}$) corresponding to a color area in which the gradation batter occurs (any one of near white level, near gray and near black level) to the gradation power supply circuit 42, and thereby the gradation batter can be removed.

Fourth Embodiment

Next, explanations will be given of the fourth embodiment of the present invention.

Figure 11:
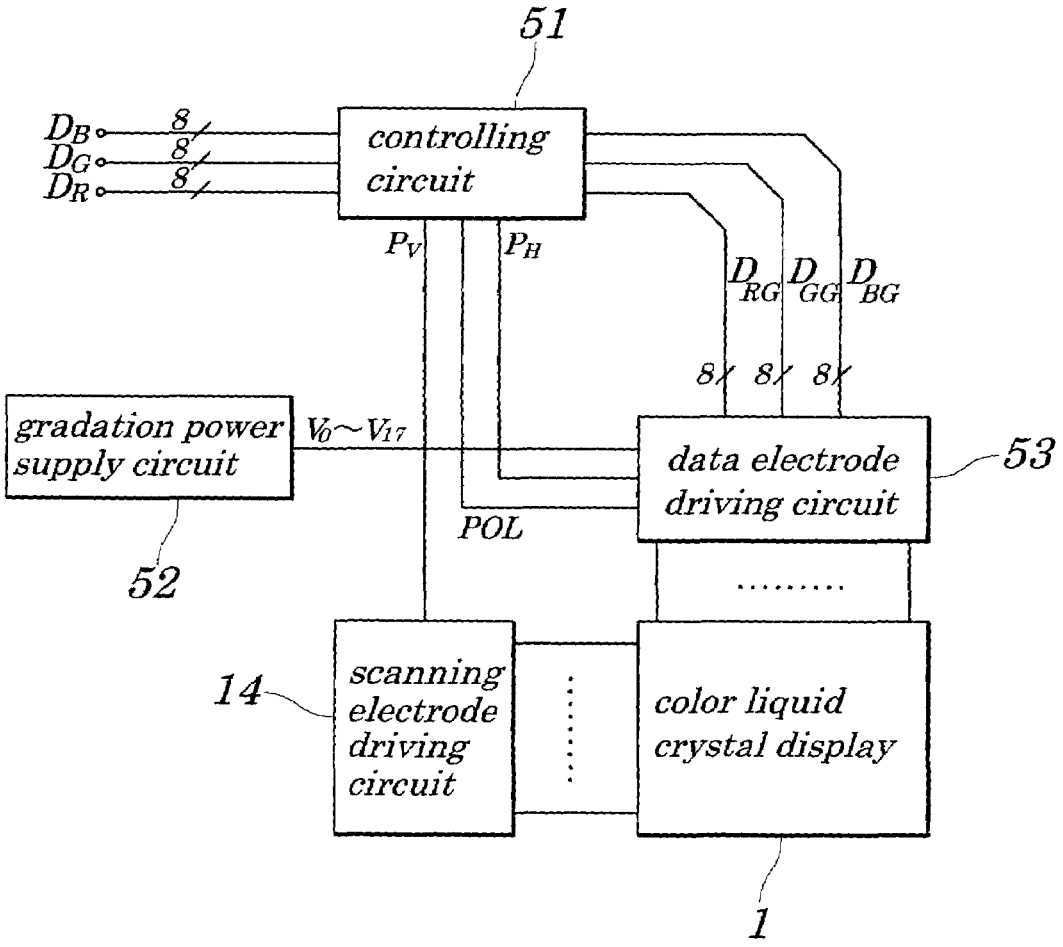
FIG. 11 is a block diagram showing an electrical configuration of a driving circuit for a color liquid crystal display according a fourth embodiment of the present invention.

FIG. 11 is a block diagram showing an electrical configuration of a driving circuit of a digital circuit configuration for the color liquid crystal display 1 according to the fourth embodiment of the present invention. In FIG. 11, same numerals are given to corresponding parts in FIG. 8 and the explanations thereof are omitted. The driving circuit for the color liquid crystal display shown 1 in FIG. 11 is provided with a controlling circuit 51, a gradation power supply circuit 52 and the data electrode driving circuit 53 instead of the controlling circuit 41, the gradation power supply circuit 42 and the data electrode driving circuit 43 in FIG. 8.

Figure 12:
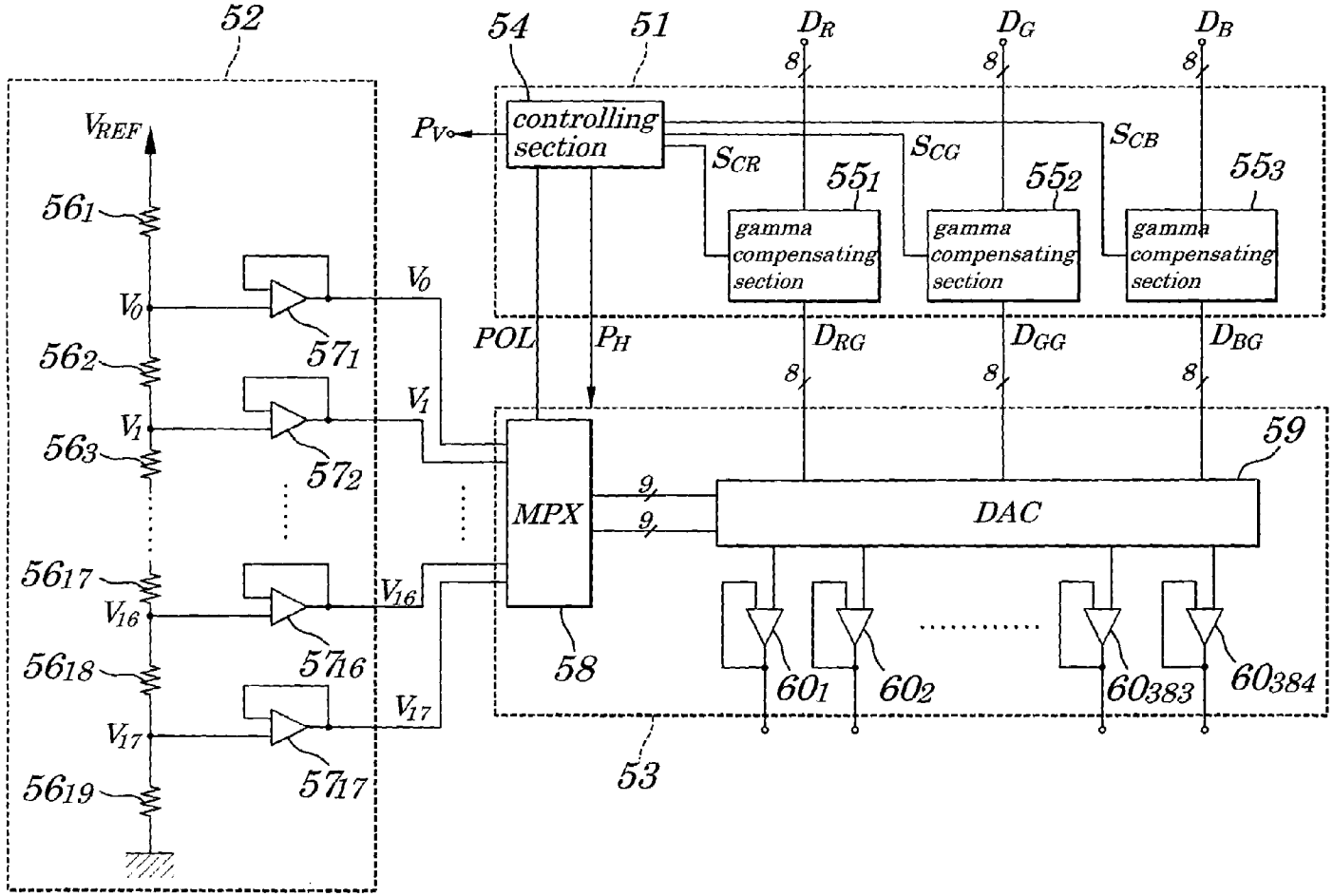
FIG. 12 is a block diagram showing an electrical configuration of a controlling circuit, a gradation power supply circuit and a data electrode driving circuit for the color liquid crystal display in the driving circuit of the fourth embodiment.

The controlling circuit 51, for example, is an ASIC, and as shown in FIG. 12, is mainly provided with a controlling section 54 and gamma compensating section $\mathbf{55}_1$ to gamma compensating section $\mathbf{55}_3$. The controlling section 54 generates a horizontal scanning pulse $P_H$, a vertical scanning pulse $P_V$ and a polarity inverting pulse POL for alternatively driving the color liquid crystal display 1 and supplies them to the data electrode driving circuit 53 and a scanning electrode driving circuit 14 and supplies a control signal $S_{CR}$, a control signal $S_{CG}$ and a control signal $S_{CB}$ for controlling gamma compensating section $\mathbf{55}_1$ to gamma compensating section $\mathbf{55}_3$. The gamma compensating section $\mathbf{55}_1$ to gamma compensating section $\mathbf{55}_3$ applies the gamma compensation independently to red data $D_R$, green data $D_G$ and blue data $D_B$ supplied from the outside by operational processes based on the control signal $S_{CR}$, the control signal $S_{CG}$ and the control signal $S_{CB}$ supplied from the controlling section 54 and gives a gradient to these data, and then respective compensation results are supplied to the data electrode driving circuit 53 as a compensated red data $D_{RG}$, a compensated green data $D_{GG}$ and a compensated blue data $D_{BG}$. In addition, the gamma compensation in gamma compensating section $\mathbf{55}_1$ to gamma compensating section $\mathbf{55}_3$ includes the first compensation and second compensation, and further includes a second slight compensation caused by differences among red, green and blue not fully compensated by a gamma rough compensation (described later) common to red, green and blue in the second gamma compensation.

The gradation power supply circuit 52, as shown in FIG. 12, is provided with resistor $\mathbf{56}_1$ to resistor $\mathbf{56}_{19}$ lengthwise connected between reference voltage $V_{REF}$ and ground and voltage follower $\mathbf{57}_1$ to voltage follower $\mathbf{57}_{17}$, each of an input terminal is connected to a connection point of the adjacent resistor. The gradation power supply circuit 52 applies buffer to gradation voltage $V_0$ to gradation voltage $V_{17}$ set for the second gamma rough compensation and supplies them to the data electrode driving circuit 53.

The data electrode driving circuit 53, as shown in FIG. 12, is mainly provided with a MPX 58, a DAC 59 of eight bits and voltage follower $\mathbf{60}_1$ to voltage follower $\mathbf{60}_{384}$. In addition, in a real data electrode driving circuit, a shift register, a data register, a latch, a level shifter and a like are provided at a front step of the DAC, however, since there are no direct relationships between the features of the present invention and these elements and operations, the explanations thereof are omitted.

The MPX 58 switches the group of gradation voltage $V_0$ to gradation voltage $V_8$ and the group of gradation voltage $V_9$ to gradation voltage $V_{17}$ among gradation voltage $V_0$ to gradation voltage $V_{17}$ supplied from the gradation power supply circuit 52 based on the polarity inverting pulse POL supplied from the controlling circuit 51 and supplies it to the DAC 59. The DAC 59 applies the second gamma rough compensation to a compensated red data $D_{RG}$ of eight bits, a compensated green data $D_{GG}$ of eight bits and a compensated blue data $D_{BG}$ of eight bits based on the group of gradation voltage $V_0$ to gradation voltage $V_8$ and the group of gradation voltage $V_9$ to gradation voltage $V_{17}$ supplied from the MPX 58, converts these data into an analog data red signal, an analog data green signal and an analog data blue signal and supplies these signals to corresponding voltage follower $\mathbf{60}_1$ to corresponding voltage follower $\mathbf{60}_{384}$. The voltage follower $\mathbf{60}_1$ to the voltage follower $\mathbf{60}_{384}$ apply buffer to the data red signal, the data green signal and the data blue signal supplied from the DAC 59 and apply these signals to the color liquid crystal display 1.

In addition, the gamma compensation in the DAC 59 is the second gamma rough compensation common to red, green and blue in the second gamma compensation. As the second gamma rough compensation common to red, green and blue, for example, when the color liquid crystal display 1 has the V-T characteristic shown in FIG. 22 (curve a to curve c), the V-T characteristic curve obtained by averaging curve a to curve c is assumed, gradation voltage $V_0$ to gradation voltage $V_{17}$ are set so that the second gamma rough compensation suitable to the assumed V-T characteristic curve is applied to the compensated red data $D_{RG}$, the compensated green data $D_{GG}$ and the compensated blue data $D_{BG}$. In this case, the gamma slight compensation is applied to differences between the assumed V-T characteristic curve and curve a to curve c in gamma compensating section $\mathbf{55}_1$ to gamma compensating section $\mathbf{55}_3$.

Figure 13:
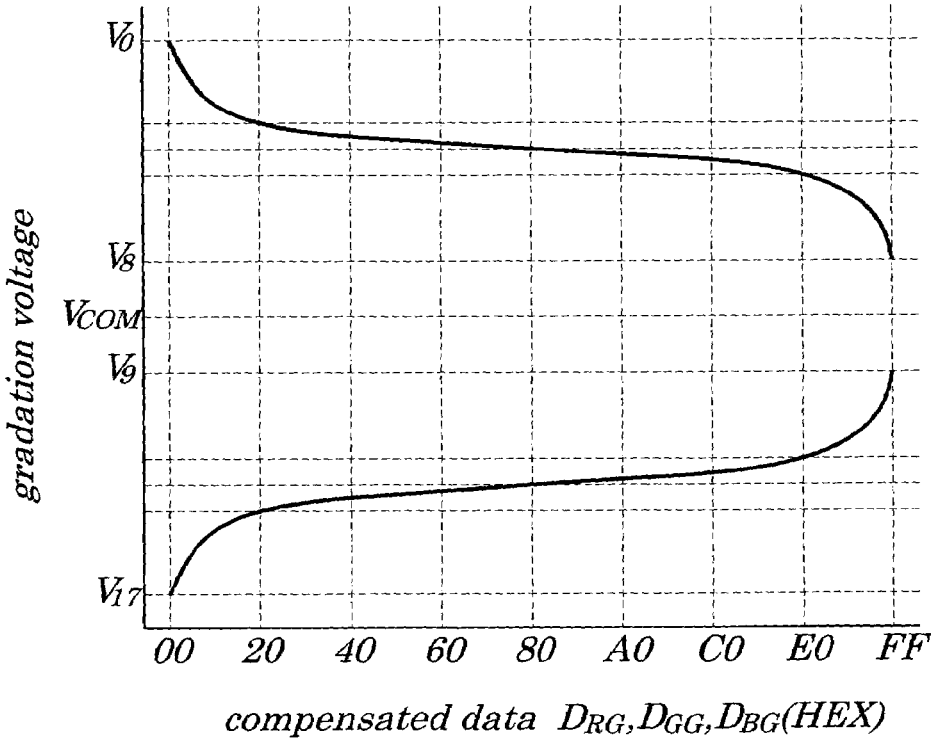
FIG. 13 is a graph showing an example of a relationship between compensated red data $D_{RG}$ of eight bits, compensated green data $D_{GG}$ of eight bits and compensated blue data $D_{BG}$ of eight bits supplied to a DAC in the data electrode driving circuit and gradation voltage $V_0$ to gradation voltage $V_8$ and gradation voltage $V_9$ to gradation voltage $V_{17}$ in the fourth embodiment.

Here, FIG. 13 shows an example of a relationship between the compensated red data $D_{RG}$ of eight bits, the compensated green data $D_{GG}$ of eight bits and the compensated blue data $D_{BG}$ of eight bits (indicated by hexadecimal number (HEX)) and gradation voltage $V_0$ to gradation voltage $V_8$ and gradation voltage $V_9$ to gradation voltage $V_{17}$. As understood from FIG. 13, in order to apply the second gamma rough compensation to the compensated red data $D_{RG}$, the compensated green data $D_{GG}$ and the compensated blue data $D_{BG}$ the group of gradation voltage $V_0$ to gradation voltage $V_8$ or gradation voltage $V_9$ to gradation voltage $V_{17}$ which have nonlinear voltage values for the compensated red data $D_{RG}$, the compensated green data $D_{GG}$ and the compensated blue data $D_{BG}$ is supplied to the DAC 59.

Next, explanations will be given of operations in the controlling circuit 51, the gradation power supply circuit 52 and the data electrode driving circuit 53 which are features of the present invention in the operations of the driving circuit for the color liquid crystal display 1.

First, the controlling circuit 51 independently applies the first gamma compensation and the second gamma slight compensation to the red data $D_R$ of eight bits, the green data $D_G$ of eight bits and the blue data $D_B$ of eight bits supplied from the outside by an operational process to give a gradient to these data, and then each of compensation results are supplied to the data electrode driving circuit 53 as the compensated red data $D_{RG}$, the compensated green data $D_{GG}$ and the compensated blue data $D_{BG}$. The gradation power supply circuit 52 applies buffer to gradation voltage $V_0$ to gradation voltage $V_{17}$ set for the second gamma rough compensation and supplies them to the data electrode driving circuit 53.

Accordingly, the data electrode driving circuit 53 applies the second gamma rough compensation to the compensated red data $D_{RG}$ of eight bits, the compensated green data $D_{GG}$ of eight bits and the compensated blue data $D_{BG}$ of eight bits supplied from the controlling circuit 51 based on the group of gradation voltage $V_0$ to gradation voltage $V_8$, or the group of gradation voltage $V_9$ to gradation voltage $V_{17}$, analog-converts these data into a data red signal, a data green signal and a data blue signal, and then applies buffer to these data so as to apply them to corresponding electrodes.

As above described, since the controlling circuit 51 executes the first gamma compensation and the second gamma slight compensation according to the fourth embodiment and the data electrode driving circuit 53 executes the second gamma rough compensation, two MPXs and two DACs can be reduced compared with the third embodiment and effects approximately similar to the third embodiment can be obtained and a circuit scale can be reduced.

Fifth Embodiment

Next, explanations will be given of the fifth embodiment of the present invention.

Figure 14:
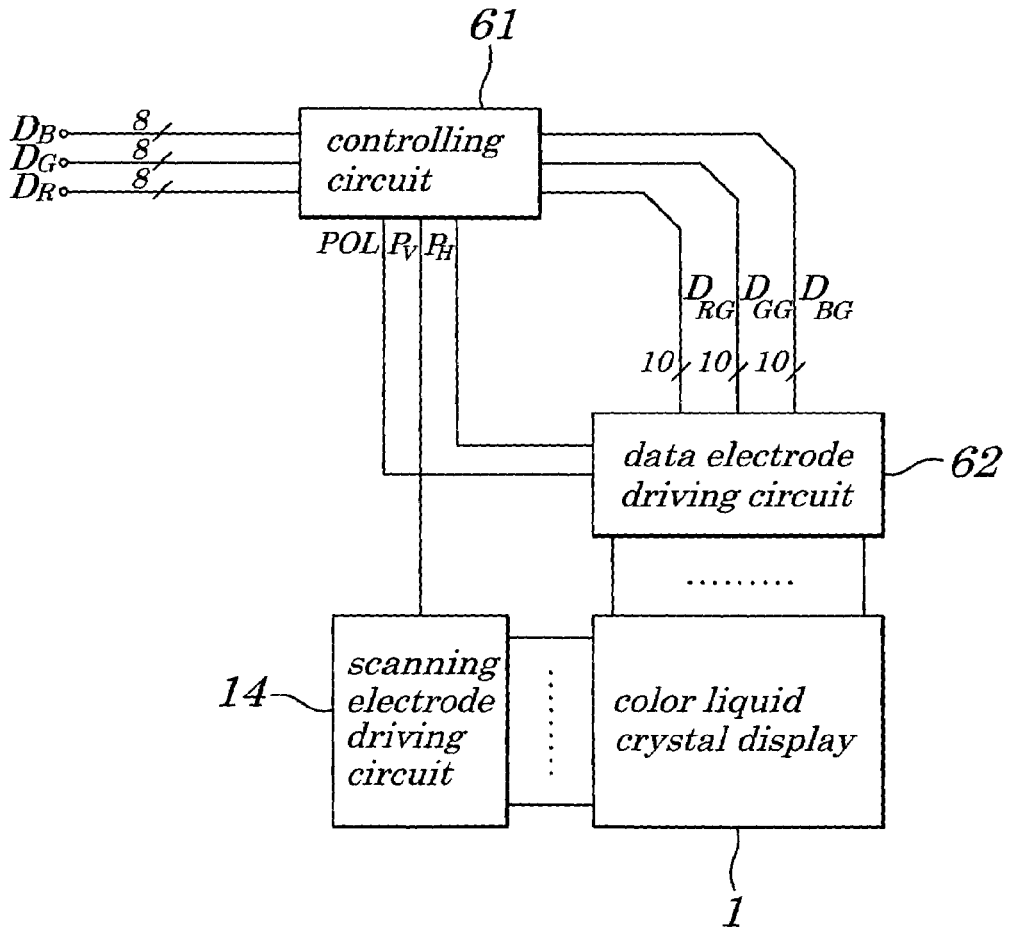
FIG. 14 is a block diagram showing an electrical configuration of a driving circuit for a color liquid crystal display according a fifth embodiment of the present invention.

FIG. 14 is a block diagram showing an electrical configuration of a driving circuit of a digital circuit configuration for the color liquid crystal display 1 according to the fifth embodiment of the present invention. In FIG. 14, same numerals are given to corresponding parts in FIG. 11 and explanations thereof are omitted. The driving circuit for the color liquid crystal display 1 shown in FIG. 14 is provided with a controlling circuit 61 and the data electrode driving circuit 62 instead of the controlling circuit 51, the gradation power supply circuit 52 and the data electrode drive circuit 53 in FIG. 11.

Figure 15:
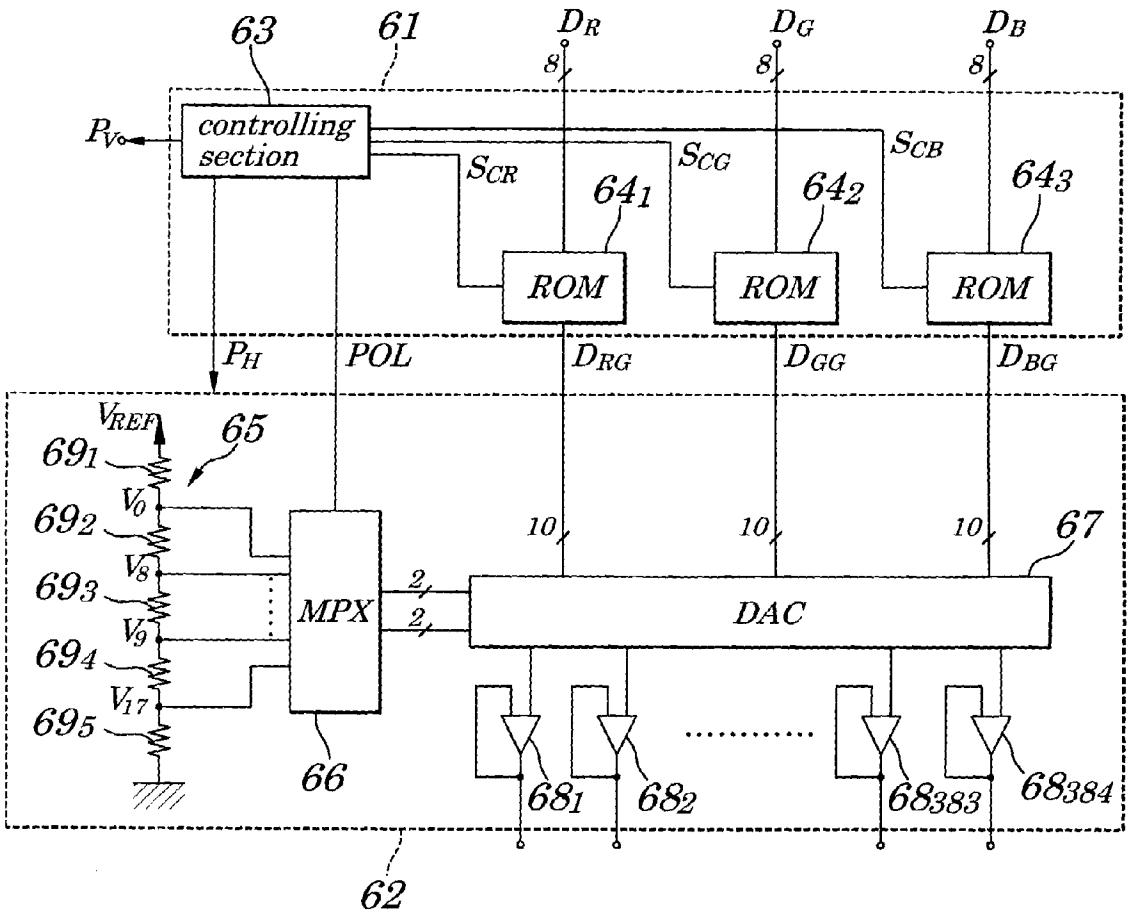
FIG. 15 is a block diagram showing an electrical configuration of a controlling circuit and a data electrode driving circuit in the driving circuit for the color liquid crystal display of the fifth embodiment.

The controlling circuit 61, for examples is an ASIC, and, as shown in FIG. 15, is mainly provided with a controlling section 63 and ROM $\mathbf{64}_1$ to ROM $\mathbf{55}_3$. The controlling section 61 generates a horizontal scanning pulse $P_H$, a vertical scanning pulse $P_V$ and a polarity inverting pulse POL for alternatively driving the color liquid crystal display 1 and supplies them to the data electrode driving circuit 62 and the scanning electrode driving circuit 14 and supplies a control signal $S_{CR}$, a control signal $S_{CG}$ and a control signal $S_{CB}$ for controlling ROM $\mathbf{64}_1$ to ROM $\mathbf{64}_3$.

The ROM $\mathbf{64}_1$ to the ROM $\mathbf{64}_3$ are look-up tables, in order to give a gradient to data by applying gamma compensation independently to red data $D_R$ of eight bits, green data $D_G$ of eight bits and blue data $D_B$ of eight bits supplied from outside, previously memorized compensated red data $D_{RG}$ of ten bits, compensated green data $D_{GG}$ of ten bits and compensated blue data $D_{BG}$ of ten bits which are respective compensated results and, when the red data $D_R$ of eight bits, the green data $D_G$ of eight bits and the blue data $D_B$ of eight bits and the control signal $S_{CR}$, the control signal $S_{CG}$ and the control signal $S_{CB}$ are supplied from the controlling section 63, reads the corresponding compensated red data $D_{RG}$ of ten bits, the corresponding compensated green data $D_{GG}$ of ten bits and the corresponding compensated blue data $D_{BG}$ of ten bits using the red data $D_R$, the green data $D_G$ and the blue data $D_B$ as referring addresses and supplies them to the data electrode driving circuit 62. In addition, the gamma compensation in ROM $\mathbf{64}_1$ to ROM $\mathbf{64}_3$ includes the first gamma compensation and the second gamma compensation.

Figure 16:
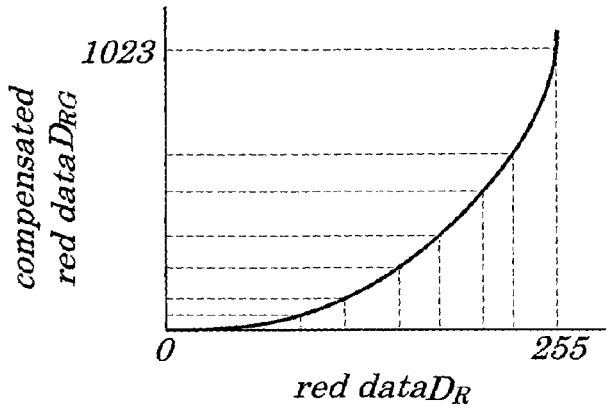
FIG. 16 is a graph showing a relationship between red data $D_R$ of eight bits and compensated red data $D_{RG}$ of ten bits memorized in a ROM in the controlling circuit of the fifth embodiment.

Here, FIG. 16 shows an example of a relationship between the red data $D_R$ of eight bits stored in the ROM $\mathbf{64}_1$ and the compensated red data $D_{RG}$ of ten bits. Not shown, however, ROM $\mathbf{64}_2$ and ROM $\mathbf{64}_3$ also memorize the green data $D_G$, the compensated green data $D_{GG}$ of ten bits corresponding to the blue data $D_B$ and the compensated blue data $D_{BG}$ similarly to FIG. 16.

The data electrode driving circuit 62, as shown in FIG. 15, is mainly provided with a gradation voltage supply source 65, a MPX 66, a DAC 59 of 10 bits and voltage follower $\mathbf{68}_1$ to voltage follower $\mathbf{68}_{384}$. In addition, in the real data electrode driving circuit, a shift register, a data register, a latch, a level shifter and a like are provided at a front step of a DAC, however, since there are no direct relationships between the features of the present invention and these elements and operations, the explanations thereof are omitted.

The gradation voltage supply source 65 is provided with resistor $\mathbf{69}_1$ to resistor $\mathbf{69}_5$ lengthwise connected between a reference voltage $V_{REF}$ and a ground and supplies a gradation voltage $V_0$, gradation voltage $V_8$ a gradation voltage V9 and a gradation voltage $V_{17}$ for converting the compensated red data $D_{RG}$ of ten bits, the compensated green data $D_{GG}$ of ten bits and the compensated blue data $D_{BG}$ of ten bits generating at connection points of adjacent resistors into an analog red signal, an analog green signal and an analog blue signal to the MPX 66.

The MPX 66 switches the group of the gradation voltage $V_0$ and the gradation voltage $V_8$ and the group of the gradation voltage $V_9$ and the gradation voltage $V_{17}$, among the gradation voltage $V_0$, the gradation voltage $V_8$ the gradation voltage $V_9$ and the gradation voltage $V_{17}$ supplied from the gradation voltage supply source 65 based on the polarity inverting pulse POL supplied from the controlling circuit 61 and supplies it to DAC 67.

The DAC 67 converts the compensated red data $D_{RG}$ of ten bits, the compensated green data $D_{GG}$ of ten bits and the compensated blue data $D_{BG}$ of ten bits into an analog red signal, an analog green signal and an analog blue signal based on the group of gradation voltage $V_0$ and the gradation voltage $V_8$ and the group of gradation voltage $V_9$ and the gradation voltage $V_{17}$ supplied from the MPX 66 and supplies these signals to corresponding voltage follower $\mathbf{60}_1$ to corresponding voltage follower $\mathbf{60}_{384}$. The voltage follower $\mathbf{60}_1$ to voltage follower $\mathbf{60}_{384}$ applies buffer to the data red signal, the data green signal and the data blue signal supplied from the DAC 66 and apply these signals to the color liquid crystal display 1.

Figure 17:
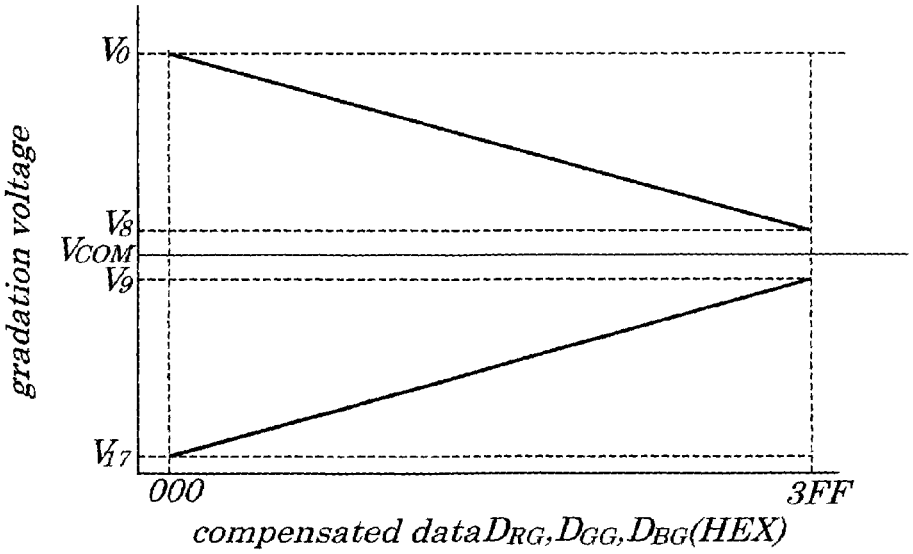
FIG. 17 is a graph showing an example of a relationship between compensated red data $D_{RG}$ of ten bits, compensated green data $D_{GG}$ of ten bits and compensated blue data $D_{BG}$ of ten bits supplied to a DAC in the data electrode driving circuit and gradation voltage $V_0$ to gradation voltage $V_8$ and gradation voltage $V_9$ to gradation voltage $V_{17}$ in the fifth embodiment.

Here, FIG. 17 shows an example of a relationship between the compensated red data $D_{RG}$ of ten bits, the compensated green data $D_{GG}$ of ten bits and the compensated blue data $D_{BG}$ of ten bits (indicated by hexadecimal number (HEX)) and gradation voltage $V_0$ to gradation voltage $V_8$ and gradation voltage $V_9$ to gradation voltage $V_{17}$. As understood from FIG. 17, the group of gradation voltage $V_0$ to gradation voltage $V_8$ or the group of gradation voltage $V_9$ to gradation voltage $V_{17}$ which have nonlinear data values for the compensated red data $D_{RG}$, the compensated green data $D_{GG}$ and the compensated blue data $D_{BG}$ is supplied to the DAC 67.

Next, explanations will be given of operations in the controlling circuit 61 and the data electrode driving circuit 62 which are features of the present invention in the operations of the driving circuit for the color liquid crystal display 1.

First, the controlling section 63 in the controlling circuit 61 supplies the control signal $S_{CR}$, the control signal $S_{CG}$ and the control signal $S_{CB}$, reads the compensated red data $D_{RG}$, the compensated green data $D_{GG}$ and the compensated blue data $D_{BG}$ of ten bits using the red data $D_R$ of eight bits, the green data $D_G$ of eight bits and the blue data $D_B$ of eight bits supplied from the outside as referring addresses and supplies them to the data electrode driving circuit 62.

Accordingly, the data electrode driving circuit 62 analog-converts the compensated red data $D_{RG}$ of ten bits, the compensated green data $D_{GG}$ of ten bits and the compensated blue data $D_{BG}$ of ten bits supplied from the controlling circuit 61 based on the group of the gradation voltage $V_0$ and the gradation voltage $V_8$ or the group of the gradation voltage $V_9$ and the gradation voltage $V_{17}$ into a data red signal, a data green signal and a data blue signal, and then applies buffer to these data so as to apply them to corresponding electrodes.

As above described, since the controlling circuit 61 executes the first gamma compensation and the second gamma compensation according to the fifth embodiment and the gradation power supply circuit 52 can be omitted compared with the fourth embodiment and effects approximately similar to the fourth embodiment can be obtained and a circuit scale can be reduced.

Also, according to fifth embodiment, only the compensated red data $D_{RG}$, the compensated green data $D_{GG}$ and the compensated blue data read from ROM $\mathbf{64}_1$ to ROM $\mathbf{64}_3$, therefore, it is possible to execute gamma compensation at higher speed than the gamma compensation using the operational process as described in the fourth embodiment.

It is apparent that the present invention is not limited to the above embodiments but may be changed and modified without departing from the scope and spirit of the invention.

Figure 18:
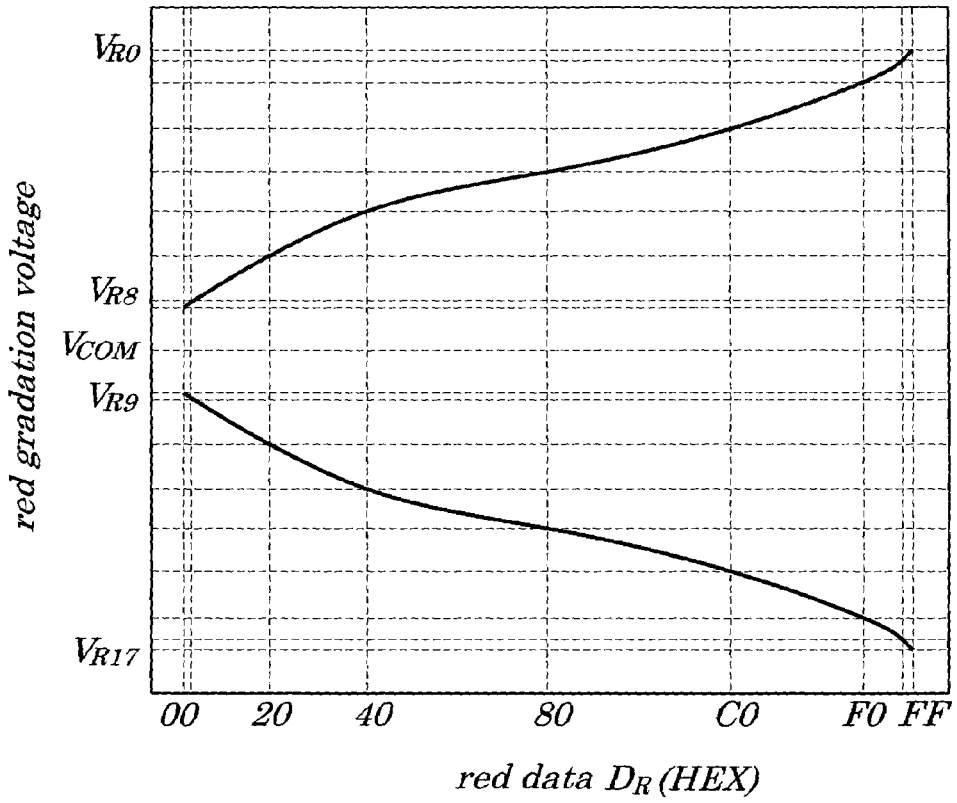
FIG. 18 is a graph showing an example of a relation between red data $D_R$ of eight bits supplied to a DAC in a data electrode driving circuit in a driving circuit for a color liquid crystal display and red gradation voltage $V_{R0}$ to red gradation voltage $V_{R8}$ and red gradation voltage $V_{R9}$ to red gradation voltage $V_{R17}$ in a modification of the third embodiment.

For example, in each of the above embodiments, the present invention is applied to a color liquid crystal display 1 of a normally white type, however, the present invention is not limited to this and may be applied to a color liquid crystal display of a normally black type in which a transmittance is low in a state that no voltage is applied. In this case, for example, in the third embodiment, not FIG. 10 but FIG. 18 shows a relationship between the red data $D_R$ of eight bits supplied to the DAC $\mathbf{47}_1$ and the group of red gradation voltage $V_{R0}$ to red gradation voltage $V_{R8}$ and the group of red gradation voltage $V_{R9}$ to red gradation voltage $V_{R17}$.

In another embodiment, the reference voltage and the gradation voltage, storage contents in ROM $\mathbf{64}_1$ to ROM $\mathbf{64}_3$ or a like may be changed so as to be suitable to the color liquid crystal display of the normally black type.

Also, in the above embodiments, the present invention is applied to the color liquid crystal display 1 of the active matrix driving type using TFT as a switch element, however, the present invention is not limited to this and may be applied any color liquid crystal display having any configuration and any function.

Also, the first gamma compensation and the second gamma slight compensation are applied by the operation process in the fourth embodiment and the first gamma compensation and the second gamma compensation are applied by reading data from the ROMs in the fifth embodiment, however, the present invention is not limited to this.

For example, in the fourth embodiment, the first gamma compensation and the second gamma slight compensation may be applied by reading data from a ROM and in the fifth embodiment, the first gamma compensation and the second gamma compensation may be applied by an operation process.

Also, Japanese Patent Application Laid-open Hei 10-313416 discloses that, concerning the first gamma compensation and the second gamma compensation, in the gamma characteristic of the color liquid crystal display 1, a gamma compensation may be applied to a curve part by reading data from a ROM, a RAM and a like and a gamma compensation may be applied to a linear part by an operation process.

Also, in the second embodiment, concerning the driving circuit of the analog configuration, the gamma compensation is applied using the common reference voltage for the video red signal $S_{RC}$, the video green signal $S_{GC}$ and the video green signal $S_{BC}$ corresponding no difference area in each of the red V-T characteristic, the green V-T characteristic and the blue V-T characteristic of the color liquid crystal display 1, and therefore, circuit scale can be reduced. It is also possible to use this technique for a driving circuit of a digital circuit configuration.

For example, in the gradation power supply circuit 42 shown in FIG. 9, since only one gradation voltage may be generated concerning a same voltage value in among red gradation voltage $V_{R0}$ to red gradation voltage $V_{R17}$, green gradation voltage $V_{G0}$ to green gradation voltage $V_{G17}$ and blue gradation voltage $V_{B0}$ to blue gradation voltage $V_{B17}$, scale of the DAC 44 and number of voltage followers 45 for generating two other gradation voltage can be reduced.

Also, in each of the above-mentioned embodiments, the first gamma compensation is that a gamma compensation is applied to give a luminance characteristic of a reproduced image to a luminance of an input image, however, in addition to the gamma compensation suitable to the gamma characteristic of the CRT display (gamma is approximately 2.2), a gamma compensation different from the gamma characteristic of the CRT display and suitable another gamma characteristic may be applied. For example, when various commodities are sold via a television broadcast or an internet, the first gamma compensation is applied so as to match a color and a design of a real commodity with those displayed on the liquid crystal display.

Furthermore, in each of the above-mentioned embodiments, the first gamma compensation always is applied, however, only the second gamma compensation may be applied.

What is claimed is:

1. A driving method for a color liquid crystal display comprising:

supplying, to a separate gamma compensating circuit for each a red video signal, a green video signal and a blue video signal, independently generated reference voltages, said reference voltages generated based upon each a red transmittance characteristic, a green transmittance characteristic and a blue transmittance characteristic;

applying gamma compensation using said separate gamma compensating circuit in order to obtain each a compensated red video signal, a compensated green video signal and a compensated blue video signal; and driving said color liquid crystal display based on said compensated red video signal, said compensated green video signal and said compensated blue video signal, wherein said reference voltages are generated to provide optimum gamma compensation based on the luminosity characteristics of each color.

2. The driving method for the color liquid crystal display according to claim 1, wherein said gamma compensations are applied using a common voltage or a common data to said video red signal, said video green signal and said video blue signal corresponding to an area in which said red transmittance characteristic, said green transmittance characteristic and said blue transmittance characteristic for said applied voltage for said color liquid crystal display become an approximate similar characteristic curve.

3. The driving method for the color liquid crystal display according to claim 1, wherein voltages or data used for said gamma compensations are independently set in an area from a minimum transmittance to a maximum transmittance of each of said red transmittance characteristic, said green transmittance characteristic and said blue transmittance characteristic for said applied voltage for said color liquid crystal display.

4. The driving method for the color liquid crystal display according to claim 3, wherein said voltages or said data are independently changeable.

5. A driving method for a color liquid crystal display comprising:

applying gamma compensation to a red signal, a green signal and a blue signal using separate gamma compensating circuits for each of said signals, said gamma compensation including a first gamma compensation of voluntarily giving a luminance characteristic of a reproduced image to an input image luminescence and a second gamma compensation of said signals conforming to a red transmittance characteristic, a green transmittance characteristic and a blue transmittance characteristic of a red video signal, a green video signal and a blue video signal, respectively; and driving said color liquid crystal display based on said compensated red video signal, said compensated green video signal and said compensated blue video signal, wherein said second gamma compensation is performed by supplying reference voltages to each of said plurality of gamma compensating circuits, said reference voltage specific to said red transmittance characteristic, said green transmittance characteristic and said blue transmittance characteristic, in order to obtain a compensated red video signal, a compensated green video signal and a compensated blue video signal.

6. The driving method for the color liquid crystal display according to claim 5, wherein said gamma compensations are applied using a common voltage or a common data to said video red signal, said video green signal and said video blue signal corresponding to an area in which said red transmittance characteristic, said green transmittance characteristic and said blue transmittance characteristic for said applied voltage for said color liquid crystal display become an approximate similar characteristic curve.

7. The driving method for the color liquid crystal display according to claim 5, wherein voltages or data used for said gamma compensations are independently set in an area from a minimum transmittance to a maximum transmittance of each of said red transmittance characteristic, said green transmittance characteristic and said blue transmittance characteristic for said applied voltage for said color liquid crystal display.

8. The driving method for the color liquid crystal display according to claim 7, wherein said voltages or said data are independently changeable.

9. A driving circuit for a color liquid crystal display comprising:

a first gamma compensating circuit for applying a gamma compensation only to a red video signal so as to be suitable only for a red transmittance characteristic for an independently applied voltage in said color liquid crystal display and for outputting only a compensated red video signal;

a second gamma compensating circuit for applying a gamma compensation only to a green video signal so as to be suitable only for a green transmittance characteristic for an independently applied voltage in said color liquid crystal display and for outputting only a compensated green video signal;

a third gamma compensating circuit for applying a gamma compensation only to a blue video signal so as to be suitable only for a blue transmittance characteristic for an independently applied voltage of said color liquid crystal display and for outputting only a compensated blue video signal;

a reference voltage generating circuit for supplying respectively independently generated reference voltages to said first gamma compensating circuit, said second gamma compensating circuit and said third gamma compensating circuit; and a data electrode driving circuit for driving corresponding electrodes of said color liquid crystal display based on said compensated red video signal, said compensated green video signal and said compensated blue video signal, wherein said reference voltages are generated to provide optimum gamma compensation based on the luminosity characteristics of each color.

10. The driving circuit for the color liquid crystal display according to claim 9, wherein said reference voltage generating circuit supplies a common reference voltage to said video red signal, said video green signal and said video blue signal corresponding an area in which said red transmittance characteristic, said green transmittance characteristic and said blue transmittance characteristic for said applied voltage in said color liquid crystal display become an approximate similar characteristic curve.

11. The driving circuit for the color liquid crystal display according to claim 9, wherein said reference voltages are independently set for each area from a minimum transmittance to a maximum transmittance in each of said red transmittance characteristic, said green transmittance characteristic and said blue transmittance characteristic for said independently applied voltages in said color liquid crystal display.

12. The driving circuit for the color liquid crystal display according to claim 11, wherein said reference voltages are independently changeable.

13. A driving circuit for a color liquid crystal display comprising:

a first gamma compensating circuit for applying a gamma compensation only to a red video signal, said gamma compensation including a first gamma compensation of voluntarily giving a luminance characteristic of a reproduced image for an input image luminance and a second gamma compensation of compensating said red video signal so as to be suitable only for a red transmittance characteristic for an independently applied voltage in said color liquid crystal display and for outputting only a compensated red video signal;

a second gamma compensating circuit for applying a gamma compensation only to a green video signal, said gamma compensation including a first gamma compensation of voluntarily giving a luminance characteristic of a reproduced image for an input image luminance and a second gamma compensation of compensating said green video signal so as to be suitable only for a green transmittance characteristic for an independently applied voltage of said color liquid crystal display and for outputting only a compensated green video signal;

a third gamma compensating circuit for applying a gamma compensation only to a blue video signal, said gamma compensation including a first gamma compensation of voluntarily giving a luminance characteristic of a reproduced image for an input image luminance and a second gamma compensation of compensating said blue video signal so as to be suitable only for a blue transmittance characteristic for an independently applied voltage of said color liquid crystal display and for outputting only a compensated blue video signal;

a reference voltage generating circuit for supplying respectively independently generated reference voltages to said first gamma compensating circuit, said second gamma compensating circuit and said third gamma compensating circuit; and a data electrode driving circuit for driving corresponding electrodes in said color liquid crystal display based on said compensated red video signal, said compensated green video signal and said compensated blue video signal.

14. The driving circuit for the color liquid crystal display according to claim 13, wherein said reference voltage generating circuit supplies a common reference voltage to said video red signal, said video green signal and said video blue signal corresponding an area in which said red transmittance characteristic, said green transmittance characteristic and said blue transmittance characteristic for said applied voltage in said color liquid crystal display become an approximate similar characteristic curve.

15. The driving circuit for the color liquid crystal display according to claim 13, wherein said reference voltages are independently set for each area from a minimum transmittance to a maximum transmittance in each of said red transmittance characteristic, said green transmittance characteristic and said blue transmittance characteristic for said independently applied voltages in said color liquid crystal display.

16. The driving circuit for the color liquid crystal display according to claim 15, wherein said reference voltages are independently changeable.

* * * * *